US011679309B2

(12) United States Patent
Onuki et al.

(10) Patent No.: US 11,679,309 B2
(45) Date of Patent: Jun. 20, 2023

(54) GOLF CLUB HEAD

(71) Applicant: SUMITOMO RUBBER INDUSTRIES, LTD., Kobe (JP)

(72) Inventors: Masahide Onuki, Kobe (JP); Hiroshi Hasegawa, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 134 days.

(21) Appl. No.: 15/833,623

(22) Filed: Dec. 6, 2017

(65) Prior Publication Data

US 2018/0093143 A1 Apr. 5, 2018

Related U.S. Application Data

(63) Continuation-in-part of application No. 14/638,657, filed on Mar. 4, 2015, now Pat. No. 9,895,581.

(30) Foreign Application Priority Data

Mar. 31, 2014 (JP) ..... JP2014-072622

(51) Int. Cl.
*A63B 53/04* (2015.01)
*A63B 60/52* (2015.01)

(52) U.S. Cl.
CPC ..... *A63B 53/04* (2013.01); *A63B 53/0466* (2013.01); *A63B 60/52* (2015.10); *A63B 53/042* (2020.08); *A63B 53/047* (2013.01); *A63B 53/0412* (2020.08); *A63B 53/0458* (2020.08); *A63B 53/0487* (2013.01)

(58) Field of Classification Search
CPC ..... A63B 53/04; A63B 53/0466; A63B 60/52; A63B 53/0412; A63B 53/042; A63B 53/0458; A63B 53/047; A63B 53/0487
See application file for complete search history.

(56) References Cited

U.S. PATENT DOCUMENTS 3,567,228 A 3/1971 Lynn
4,498,672 A * 2/1985 Bulla ..... A63B 53/04 473/332
5,176,383 A * 1/1993 Duclos ..... A63B 53/04 473/342

(Continued)

FOREIGN PATENT DOCUMENTS

CN 201091775 Y 7/2008
CN 102895766 A 1/2013

(Continued)

*Primary Examiner* — William M Pierce
(74) *Attorney, Agent, or Firm* — Birch, Stewart, Kolasch & Birch, LLP

(57) ABSTRACT

A head 2 includes a head body h1, a face part Fp1, and a connecting part Cn1. The face part Fp1 includes a face surface f1 and a face back surface f2. The connecting part Cn1 connects the face back surface f2 of the face part Fp1 and the head body h1 to each other. The connecting part Cn1 may be provided at a position separated from a peripheral edge of the face back surface f2. The peripheral edge of the face back surface f2 may be separated from the head body h1. The face part Fp1 may include a face middle region R1 and a face peripheral region R2. The connecting part Cn1 may be provided only in the face middle region R1.

5 Claims, 43 Drawing Sheets

(56) References Cited

U.S. PATENT DOCUMENTS 5,299,807 A * 4/1994 Hutin ..... A63B 53/04 473/329
5,499,814 A * 3/1996 Lu ..... A63B 53/04 473/329
5,628,697 A * 5/1997 Gamble ..... A63B 21/0602 473/326
RE35,955 E * 11/1998 Lu ..... A63B 53/04 473/329
6,368,231 B1 * 4/2002 Chen ..... A63B 53/04 473/329
7,211,006 B2 * 5/2007 Chang ..... A63B 53/04 473/329
7,582,024 B2 * 9/2009 Shear ..... A63B 53/0466 473/329
2002/0183134 A1 * 12/2002 Allen ..... A63B 53/04 473/329
2011/0294599 A1 * 12/2011 Albertsen ..... A63B 53/0466 473/349
2011/0319190 A1 * 12/2011 Wada ..... A63B 53/0466 473/349
2012/0021849 A1 * 1/2012 Gibbs ..... A63B 53/02 473/342
2012/0135821 A1 * 5/2012 Boyd ..... A63B 53/0466 473/342
2013/0029782 A1 1/2013 Goto
2015/0352415 A1 * 12/2015 Bennett ..... A63B 60/54 473/329
2017/0239533 A1 * 8/2017 Cole ..... A63B 53/0475

FOREIGN PATENT DOCUMENTS

JP 10-263118 A 10/1998
JP 11-114102 A 4/1999
JP 2003-325709 A 11/2003
JP 2005-270321 A 10/2005
JP 2010-279847 A 12/2010

* cited by examiner

GOLF CLUB HEAD

This application is a Continuation-in-Part of copending application Ser. No. 14/638,657, filed on Mar. 4, 2015, which claims priority under 35 U.S.C. § 119(a) to Application No. 2014-072622, filed in JAPAN on Mar. 31, 2014, all of which are hereby expressly incorporated by reference into the present application.

BACKGROUND OF THE INVENTION

Field of the Invention

The present invention relates to a golf club head.

Description of the Related Art

A wood type, iron type, hybrid type, utility type, and putter type golf club heads or the like are known as a golf club head. A variation in a hit point is inevitably generated in the heads of all the types. A head having high rebound performance at all the hit point positions is preferable.

In a head disclosed in Japanese Patent Application Laid-Open No. 2012-5679 (US2011/0319190), a face part includes a thick part located in a middle, and an outer peripheral part located at an outer periphery of the thick part. The thick part includes a central part having the greatest thickness, a first ridge surrounding the central part, and a first valley located between the central part and the first ridge. An object of the invention of the gazette is to provide a head in which a CT value in a hit point other than a sweet spot is almost equal to a CT value in the sweet spot.

Japanese Patent Application Laid-Open No. 2010-279847 discloses a hollow golf club head including a face part and a head main part. The head main part includes a fold-like part bent in an approximately U-shaped section. The fold-like part forms a groove-like part in an outer surface of the head. The fold-like part extends to a crown part, a side part, and a sole part along a peripheral edge of a face surface. The fold-like part can decrease the rigidity of the whole head to achieve high rebound performance.

Japanese Unexamined Patent Application Publication No. 2013-527008 (US2011/0294599) discloses a hollow head having a stress reduction feature (SRF). The SRF includes a crown side SRF and a sole side SRF.

Ahead structure intended so that a face part is deflected in a well-balanced manner is disclosed in Japanese Patent Application Laid-Open No. 11-114102. In the head, a tangent of a face surface is S1; a face side tangent of a crown face is S2; a face side tangent of a sole surface is S3; an angle between the tangent S1 and the tangent S2 is $\alpha$; an angle between the tangent S1 and the tangent S3 is $\alpha$; and a supplementary angle of the angle $\beta$ in the tangent S3 is $\gamma$. In the head, $\alpha$ and $\beta$ are almost equal to each other, or $\alpha$ and $\gamma$ are almost equal to each other.

Japanese Patent Application Laid-Open No. 10-263118 discloses a hollow head including a deformation promoting part. The deformation promoting part increases the deflection of a face part, or increases the relative displacement of the face part to the head. As the deformation promoting part, a thin-walled groove or a penetration groove provided in the face part is disclosed.

U.S. Pat. No. 7,582,024 discloses a head including a main body and a face insert. A slot is provided around the main body near the face insert.

Japanese Patent Application Laid-Open No. 2003-325709 discloses a golf club head in which a plurality of joint pieces connecting a face wall part and a back face wall part to each other, and a void located between the joint pieces are formed.

SUMMARY OF THE INVENTION

There is room for an improvement in rebound performance in a peripheral edge part of a face.

It is an object of the present invention to provide a golf club head having excellent rebound performance.

A preferable first golf club head includes a head body; a face part; and a connecting part. The face part includes a face surface and a face back surface. The connecting part connects the head body and the face part to each other. A peripheral edge of the face back surface is separated from the head body.

A preferable second golf club head includes a head body; a face part; and a connecting part. The face part includes a face surface and a face back surface. The connecting part connects the face back surface and the head body to each other. The connecting part is provided at a position separated from a peripheral edge of the face back surface.

Preferably, the head body includes a cavity part and a front part disposed in front of the cavity part. Preferably, the connecting part connects the front part and the face back surface to each other.

Preferably, the whole peripheral edge of the face back surface is separated from the head body.

A preferable third golf club head includes a head body; a face part; and a connecting part. The head body includes a cavity part and a front part disposed in front of the cavity part. The front part connects an upper part of the head body and a lower part of the head body to each other. The connecting part connects the front part and the face part to each other. A peripheral edge of the face part is separated from the head body.

Preferably, the whole peripheral edge of the face part is separated from the head body.

Preferably, the face part includes a face middle region and a face peripheral region; and the connecting part is provided only in the face middle region.

Preferably, an average CT value in the face peripheral region is greater than an average CT value in the face middle region.

Preferably, a CT value in a face center is 160 μs or greater and 257 μs or less.

Preferably, a head volume is 100 cc or greater and less than 300 cc.

Preferably, a CT value in a face center is 160 μs or greater and 257 μs or less. Preferably, a head volume is 100 cc or greater and less than 300 cc.

DESCRIPTION OF THE PREFERRED EMBODIMENTS

The present invention will be described below in detail based on preferred embodiments with appropriate reference to the drawings.

Figure 1:
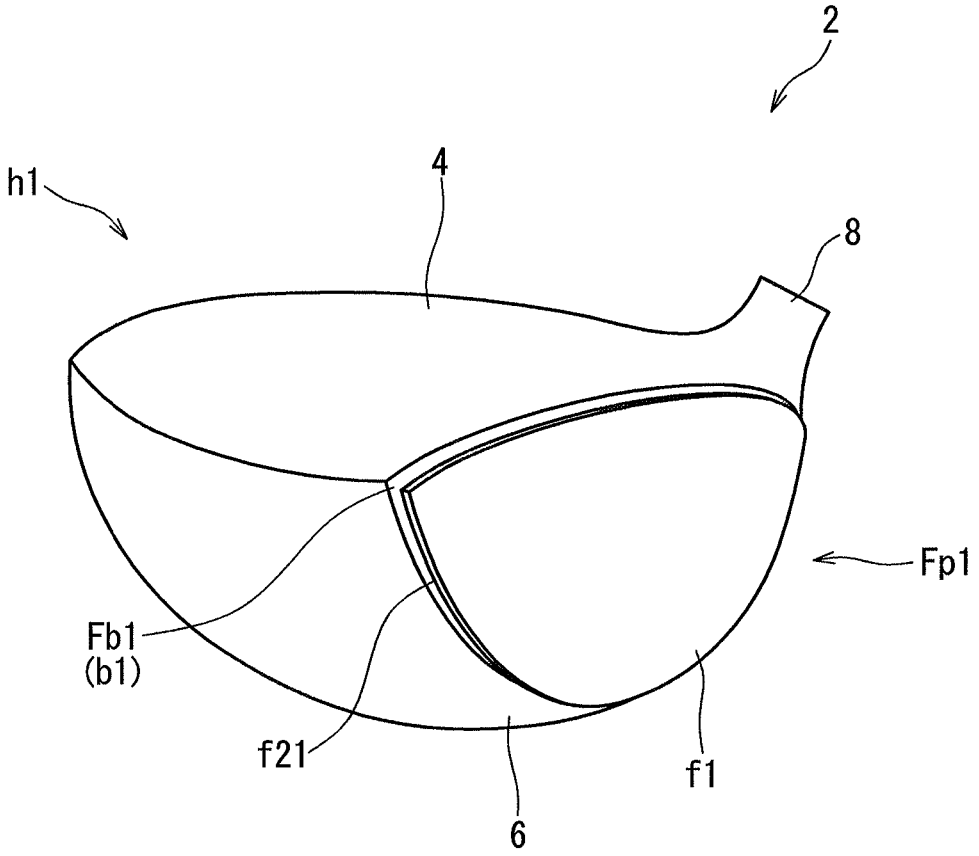
FIG. 1 is a perspective view of a golf club head according to a first embodiment.
Figure 2:
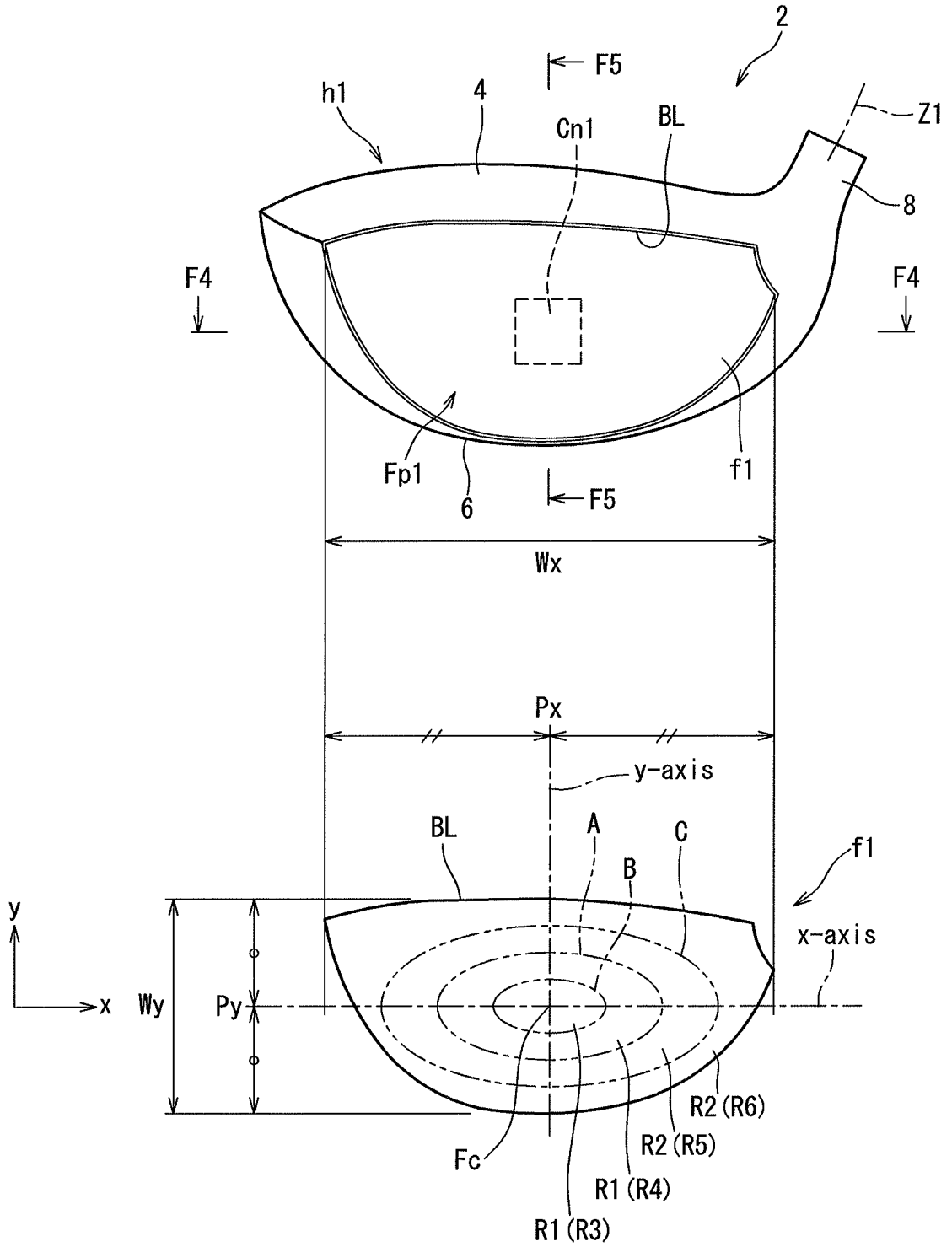
FIG. 2 is a front view of the head of FIG. 1, and describes a face surface in a planar view together.
Figure 3:
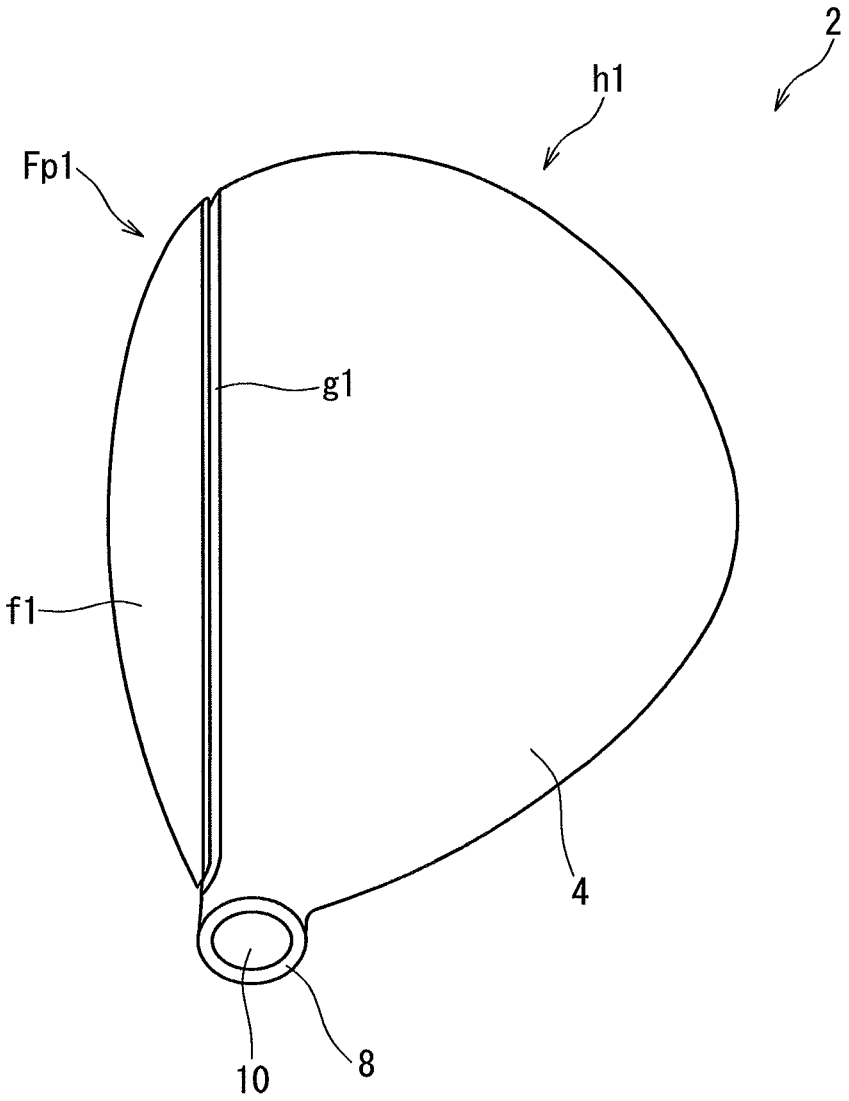
FIG. 3 is a top view of the head of FIG. 1.
Figure 4:
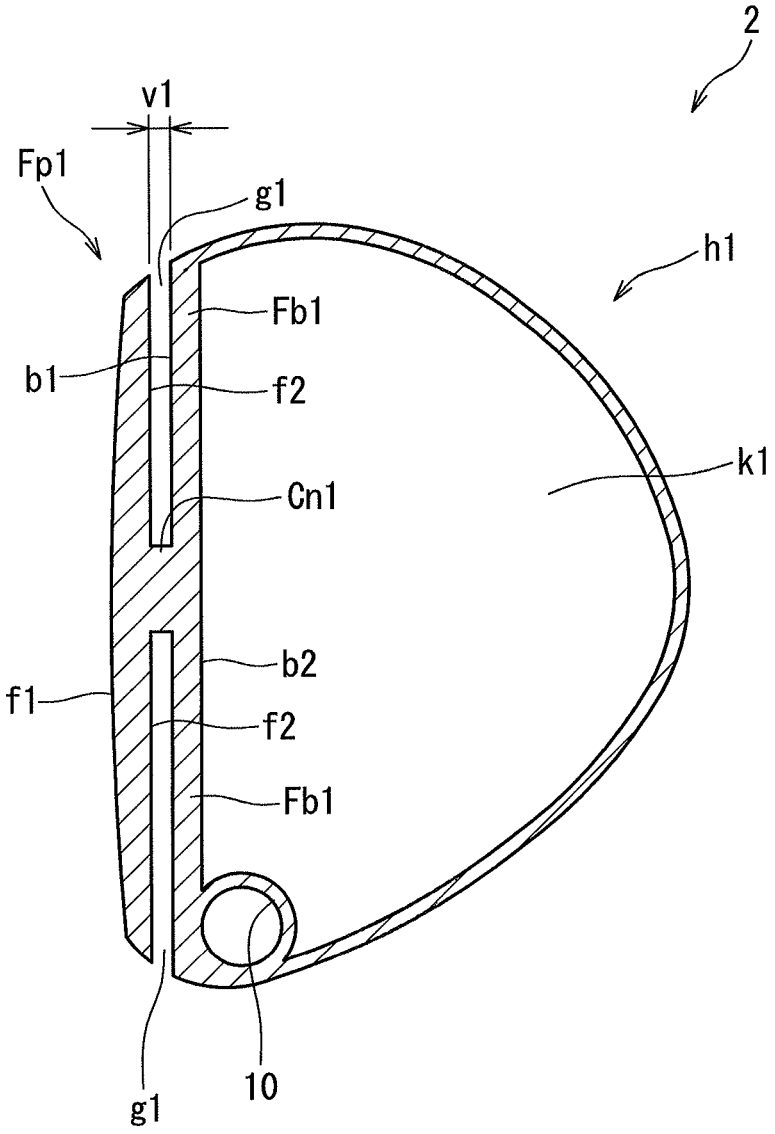
FIG. 4 is a cross-sectional view taken along line F4-F4 of FIG. 2.
Figure 5:
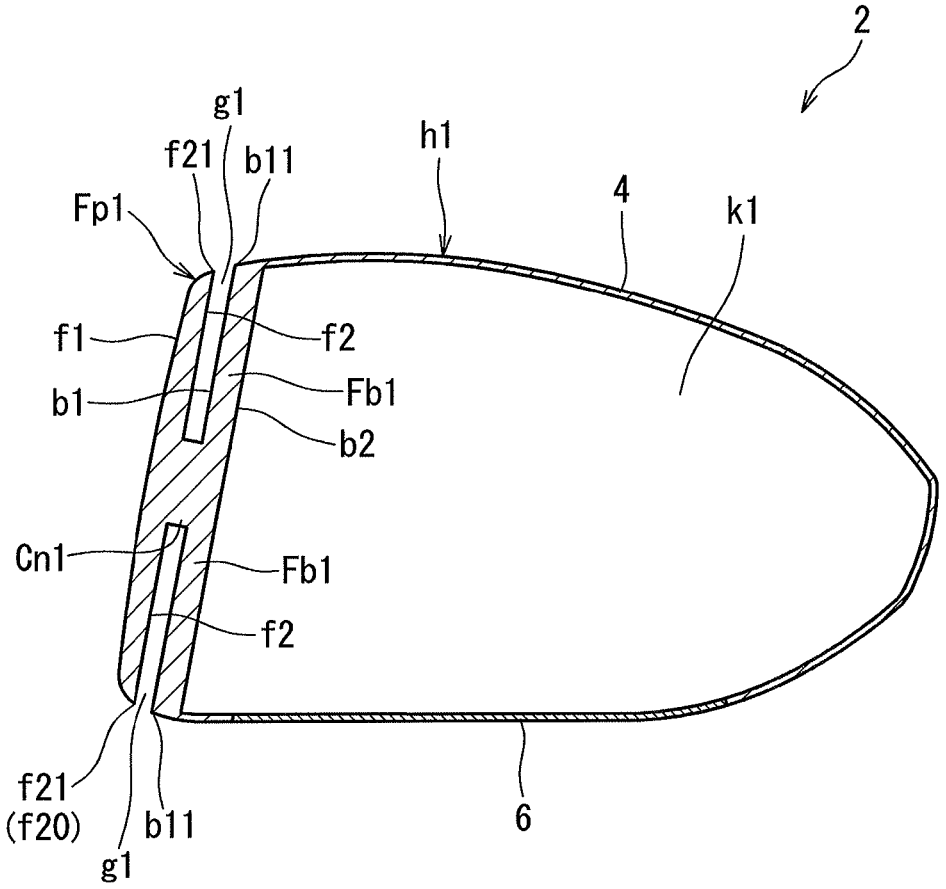
FIG. 5 is a cross-sectional view taken along line F5-F5 of FIG. 2.
Figure 6:
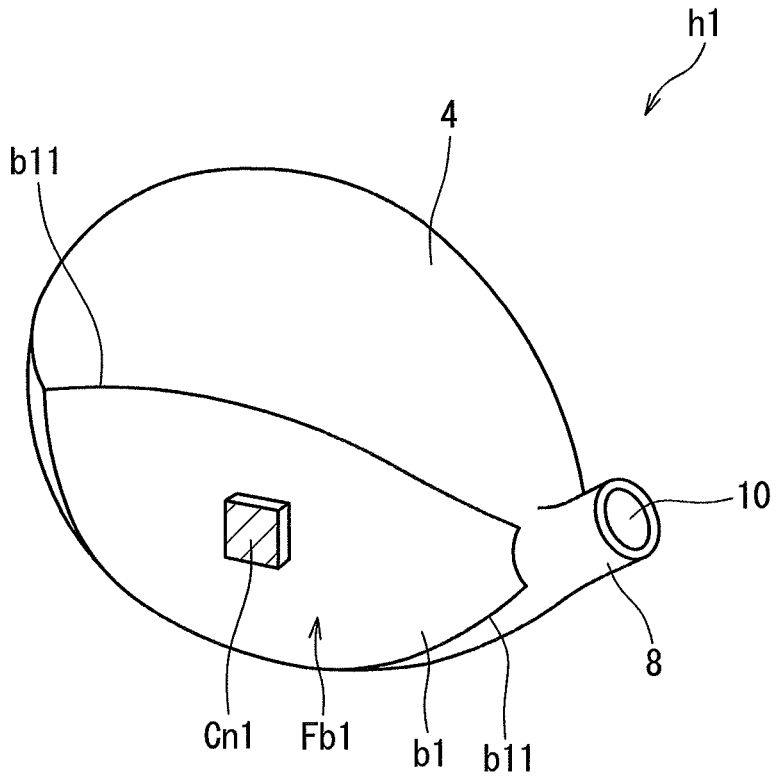
FIG. 6 is a perspective view of a head body used for the head of FIG. 1.
Figure 7:
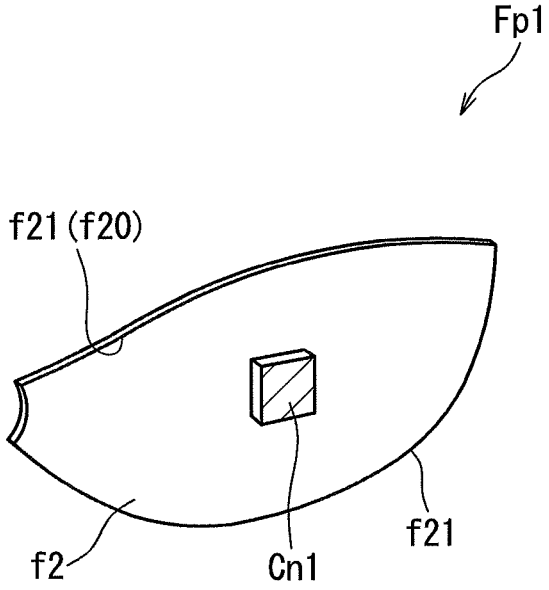
FIG. 7 is a perspective view of a face part used for the head of FIG. 1.

FIG. 1 is a perspective view of a golf club head 2 according to one embodiment of the present invention. FIG. 2 is a front view of the head 2. In addition to the front view of the head 2, a border line BL of a face surface f1 in a planar view is described in FIG. 2. FIG. 3 is a top view of the head 2. FIG. 4 is a cross-sectional view taken along line F4-F4 of FIG. 2. FIG. 5 is a cross-sectional view taken along line F5-F5 of FIG. 2. FIG. 6 is a perspective view of a head body h1. FIG. 6 includes a part of a connecting part Cn1. FIG. 7 is a perspective view of a face part Fp1. FIG. 7 includes a part of the connecting part Cn1.

The head 2 is a wood type head. The head 2 is a driver head. As described below, the head 2 may be a utility type (hybrid type) head, an iron type head, or a putter type head.

The head 2 includes a head body h1, a face part Fp1, and a connecting part Cn1. The face part Fp1 includes a peripheral edge f20. The connecting part Cn1 connects the head body h1 and the face part Fp1 to each other. The face part Fp1 is connected to the head body h1 by only the connecting part Cn1.

The head body h1 includes a crown 4, a sole 6, and a hosel 8. As shown in FIGS. 3 and 6, the hosel 8 includes a hosel hole 10.

The inside of the head body h1 is a space. In other words, as shown in FIGS. 5 and 6, the head body h1 includes a cavity part k1. The cavity part k1 is a hollow part. The head 2 is a hollow head. In the present application, the "cavity part" is a concept including a hollow part and a recess part. The cavity part may be a closed space. The cavity part may be an opened space.

The head body h1 includes a front part Fb1 (see FIGS. 4, 5, and 6). The front part Fb1 is disposed in front of the cavity part k1. The cavity part k1 is present behind the front part Fb1. The front part Fb1 shields at least a part of a front of the cavity part k1. As shown in FIG. 6, in the head 2, the front part Fb1 blocks the whole front of the cavity part k1. The front part Fb1 is located behind the face part Fp1.

As in the head 2, the front part Fb1 may be located at a foremost position of the head body h1. Meanwhile, the front part Fb1 may not be located at the foremost position of the head body h1. For example, the front part Fb1 may be located behind a forward edge of the head body h1.

The front part Fb1 connects an upper part of the head body h1 and a lower part of the head body h1 to each other. In the present embodiment, the upper part of the head body h1 is the crown 4. In the embodiment, the lower part of the head body h1 is the sole 6. The face part Fp1 is connected to the front part Fb1 by only the connecting part Cn1.

The connecting part Cn1 is integrally molded with the face part Fp1 and the front part Fb1. The integral molding method is lost-wax casting. The connecting part Cn1 may be joined to the face part Fp1. The connecting part Cn1 may be joined to the front part Fb1. In respect of a strength, the joining method is preferably welding.

The front part Fb1 includes a front surface b1 and a back surface b2. The back surface b2 faces the cavity part k1. The connecting part Cn1 connects the front surface b1 and the face part Fp1 to each other.

The face part Fp1 includes a face surface f1 and a face back surface f2. The face surface f1 is a hitting surface. The face back surface f2 is opposed to the front surface b1.

The face part Fp1 is wholly plate-like. A clearance g1 is provided between the face part Fp1 and the front part Fb1 (see FIGS. 4 and 5).

A plurality of score line grooves are formed in the face surface f1. These score line grooves are abbreviated in the drawings.

The face surface f1 is a curved surface. The face surface f1 is a three-dimensional curved surface convexed to the outer side. As in a general wood type head, the face surface f1 includes a bulge and a roll.

In the present embodiment, the face back surface f2 is a plane. The face back surface f2 maybe a curved surface. For example, the face back surface f2 may be a curved surface along the face surface f1. In Examples to be described below, the face back surface f2 is a curved surface along the face surface f1.

The connecting part Cn1 connects the face back surface f2 and the front surface b1 to each other. Except for a portion in which the connecting part Cn1 is present, the clearance g1 is present between the face back surface f2 and the front surface b1.

As shown in FIGS. 4 and 5, the connecting part Cn1 is solid. The connecting part Cn1 may be hollow.

[Definitions of Terms]

The following terms are defined in the present application.

[Base State, Base Perpendicular Plane]

A plane VP1 perpendicular to a level surface H is set (abbreviated in the drawings). A state where a center axis line Z1 of a shaft hole is included in the plane VP1 and a head is placed at a specified lie angle and real loft angle on the level surface H is defined as a base state (abbreviated in the drawings). The plane VP1 is defined as a base perpendicular plane. The specified lie angle and real loft angle are described in, for example, a product catalog.

[Toe-Heel Direction]

A toe-heel direction is a direction of an intersection line between the base perpendicular plane VP1 and the level surface H.

[Face-Back Direction]

A face-back direction is a direction perpendicular to the toe-heel direction and parallel to the level surface H.

[Vertical Direction]

A vertical direction is a direction perpendicular to the level surface H.

[Face Projection Plane]

A face projection plane is a plane perpendicular to a face normal line. The face normal line is a straight line passing through a face center Fc and being perpendicular to the face surface f1. If the face surface f1 is a curved surface, a tangent plane in the face center Fc is considered. That is, the face normal line is a straight line being perpendicular to the tangent plane and passing through the face center Fc.

[Planar View]

A projection image to the face projection plane is defined as a planar view. A face border view described on a lower side in FIG. 2 is the planar view. In the projection to the face projection plane, the projection direction is the direction of the face normal line.

[Up-Down Direction]

A straight line extending in the vertical direction is projected on the face projection plane. A direction of the projected straight line is defined as an up-down direction. Therefore, the up-down direction is parallel to the face projection plane.

[Face Center Fc]

In FIG. 2, a border view (face border view) of the face surface f1 in the planar view is described with the front view of the head 2. As shown in FIG. 2, in the face surface f1, a maximum width Wx in the toe-heel direction is determined. Furthermore, a middle position Px of the maximum width Wx in the toe-heel direction is determined. At the position Px, a width Wy of the face surface f1 in the up-down direction is determined, and a center position Py of the width Wy in the up-down direction is determined. A point at which a position in the toe-heel direction is Px and a position in the up-down direction is Py is defined as a face center Fc. The face center Fc is estimated in the planar view.

[Face Middle Region R1]

In the face surface f1 in the planar view, an ellipse A having its center at the face center Fc is defined (see the face border view in FIG. 2). A major axis of the ellipse A is half the width Wx. A minor axis of the ellipse A is half the width Wy. An inner side region of the ellipse A is a face middle region R1. The region R1 is determined in the planar view.

[Face Peripheral Region R2]

A region other than the face middle region R1 is a face peripheral region R2. The face peripheral region R2 is located around the face middle region R1. The ellipse A divides the face surface f1 into the face middle region R1 and the face peripheral region R2. An outer edge of the face peripheral region R2 is the border line BL of the face surface f1. The region R2 is determined in the planar view.

[Middle Inner Side Region R3]

In the face surface f1 in the planar view, an ellipse B having its center at the face center Fc is defined (see the face border view in FIG. 2). A major axis of the ellipse B is ¼ of the width Wx. A minor axis of the ellipse B is ¼ of the width Wy. An inner side region of the ellipse B is a middle inner side region R3. The region R3 is determined in the planar view.

[Middle Outer Side Region R4]

A region located between the ellipse A and the ellipse B is a middle outer side region R4. In other words, the middle outer side region R4 is a portion excluding the middle inner side region R3 in the face middle region R1. The ellipse B divides the face middle region R1 into the middle inner side region R3 and the middle outer side region R4. The region R4 is determined in the planar view.

[Peripheral Inner Side Region R5]

In the face surface f1 in the planar view, an ellipse C having its center at the face center Fc is defined (see the face border view in FIG. 2). A major axis of the ellipse C is ¾ of the width Wx. A minor axis of the ellipse C is ¾ of the width Wy. A region located between the ellipse C and the ellipse A is a peripheral inner side region R5. The region R5 is determined in the planar view.

[Peripheral Outer Side Region R6]

A region located outside the ellipse C is a peripheral outer side region R6. In other words, the peripheral outer side region R6 is a portion excluding the peripheral inner side region R5 in the face peripheral region R2. An outer edge of the peripheral outer side region R6 is the border line BL of the face surface f1. The region R6 is determined in the planar view.

[CT Value]

A CT value is well known to a person skilled in the art. A characteristic time of the head is referred to as the CT value. The CT value is measured based on the existing Pendulum Test of USGA. The Pendulum Test is described in detail in "Technical Description of the Pendulum Test" attached to "Notice To Manufacturers" issued by USGA on Feb. 24, 2003. The unit of the CT value is μs. Rebound performance tends to be higher as the CT value is larger.

[Average CT Value]

A two-dimensional xy-coordinate system is defined in the face surface f1 in the planar view (see the face border view in FIG. 2). A y-axis of the xy-coordinate system is parallel to the up-down direction. An x-axis of the xy-coordinate system is perpendicular to the y-axis. An origin of the xy-coordinate system is the face center Fc. The plus side of an x-coordinate is a heel side. The minus side of the x-coordinate is a toe side. The plus side of a y-coordinate is an upper side. The minus side of the y-coordinate is a lower side (sole side).

Measurement points of the CT value are set in the xy-coordinate system. These measurement points are intersection points of lattice lines drawn at intervals of 5 mm (abbreviated in the drawings). The measurement points are determined based on the x-coordinate and the y-coordinate. The measurement points are set at intervals of 5 mm in each of the x-coordinate and the y-coordinate. The x-coordinates (mm) of the measurement points are 5N. N is all integers. The y-coordinates (mm) of the measurement points are 5M. M is all integers. The coordinates (x, y) of the measurement points are (5N, 5M). In each of the x-coordinate and the y-coordinate, the measurement points are set at intervals of 5 mm. For example, if the y-coordinate is 0, the coordinates (x, y) of the measurement points are (0, 0), (5, 0), (10, 0), (15, 0), (20, 0), (−5, 0), (−10, 0), (−15, 0), and (−20, 0) or the like. For example, if the y-coordinate is 5, the coordinates (x, y) of the measurement points are (0, 5), (5, 5), (10, 5), (15, 5), (20, 5), (−5, 5), (−10, 5), (−15, 5), and (−20, 5) or the like. The measurement points are set over the whole range of the face surface f1. The CT values are measured in all the measurement points as long as the CT values can be measured.

The average CT value is an average value of the CT values in all the measurement points. For example, an average CT value in the face middle region R1 is an average of the CT values measured in all the measurement points which are present in the face middle region R1.

An average CT value in the face middle region R1 is defined as CT1. An average CT value in the face peripheral region R2 is defined as CT2. An average CT value in the middle inner side region R3 is defined as CT3. An average CT value in the middle outer side region R4 is defined as CT4. An average CT value in the peripheral inner side region R5 is defined as CT5. An average CT value in the peripheral outer side region R6 is defined as CT6.

[Toe Region]

A toe region is defined in the face surface f1 in the planar view. The toe region is a region located on a toe side with respect to the face center Fc. In the face border view of FIG. 2, the left side of the y-axis is the toe region.

[Heel Region]

A heel region is defined in the face surface f1 in the planar view. The heel region is a region located on a heel side with respect to the face center Fc. In the face border view of FIG. 2, the right side of the y-axis is the heel region.

[Upper Region]

An upper region is defined in the face surface f1 in the planar view. The upper region is a region located on an upper side with respect to the face center Fc. In the face border view of FIG. 2, the upper side of the x-axis is the upper region.

[Lower Region]

A lower region is defined in the face surface f1 in the planar view. The lower region is a region located on a lower side with respect to the face center Fc. In the face border view of FIG. 2, the lower side of the x-axis is the lower region.

As described above, the face part Fp1 includes the face surface f1 and the face back surface f2. As shown in FIG. 7, the face back surface f2 includes a peripheral edge f21. In the present embodiment, the peripheral edge f21 of the face back surface f2 is also the peripheral edge f20 of the face part Fp1. The peripheral edge f21 and the peripheral edge f20 may not coincide with each other depending on the shape of the peripheral edge of the face part Fp1. As shown in FIG. 7, the connecting part Cn1 is provided at a position separated from the peripheral edge f21. As shown in FIG. 7, the connecting part Cn1 is provided at a position separated from the peripheral edge f20.

In the present embodiment, the shape of the connecting part Cn1 in the planar view is a rectangle. In more detail, the shape of the connecting part Cn1 in the planar view is a square.

As shown in FIG. 7, in the head 2, the whole peripheral edge f20 is separated from the connecting part Cn1. In the head 2, the whole peripheral edge f21 of the face back surface f2 is separated from the connecting part Cn1. A part of the peripheral edge f21 (peripheral edge f20) may be separated from the connecting part Cn1. In other words, the connecting part Cn1 may be joined to a part of the peripheral edge f21 (peripheral edge f20). In respect of the rebound performance of a face peripheral edge part, 50% or greater of the peripheral edge f21 (peripheral edge f20) is preferably separated from the connecting part Cn1; 70% or greater of the peripheral edge f21 (peripheral edge f20) is more preferably separated from the connecting part Cn1; 90% or greater of the peripheral edge f21 (peripheral edge f20) is still more preferably separated from the connecting part Cn1; and 100% of the peripheral edge f21 (peripheral edge f20) is yet still more preferably separated from the connecting part Cn1. In the head 2, 100% of the peripheral edge f21 (peripheral edge f20) is separated from the connecting part Cn1.

The connecting part Cn1 is located on the face center Fc side with respect to the peripheral edge f21. The connecting part Cn1 is located in the face middle region R1. The whole connecting part Cn1 is located in the face middle region R1. A backup region B1 (described below) includes the face center Fc. At least a part of the connecting part Cn1 is located in the middle inner side region R3.

As described above, the front part Fb1 of the head body h1 includes the front surface b1. As shown in FIG. 6, the front surface b1 includes a peripheral edge b11.

As shown in FIG. 6, in the head 2, the peripheral edge b11 is separated from the connecting part Cn1. The whole peripheral edge b11 is separated from the connecting part Cn1. A part of the peripheral edge b11 may be separated from the connecting part Cn1. In other words, the connecting part Cn1 may be disposed on a part of the peripheral edge b11.

As shown in FIG. 5, the peripheral edge f21 (peripheral edge f20) is separated from the head body h1. The whole peripheral edge f21 (peripheral edge f20) is separated from the head body h1. The peripheral edge f21 (peripheral edge f20) is separated from the front part Fb1. A space is provided behind the peripheral edge f21 (peripheral edge f20). The space is not connected to the hollow part of the head body h1. The space provided behind the peripheral edge f21 (peripheral edge f20), and the hollow part of the head body h1 are divided by the front part Fb1. The space forms the clearance g1. The clearance g1 is present between the peripheral edge f21 and the head body h1. In the whole peripheral edge f21, the clearance g1 is present between the peripheral edge f21 and the head body h1. The clearance g1 easily causes the displacement of the peripheral edge f21. The face surface f1 is easily deformed in hitting. A peripheral edge part of the face part Fp1 has a high degree of freedom of deformation. The peripheral edge part of the face part Fp1 is once displaced backward by the deformation, and then returned to the front. Since the peripheral edge f21 is separated from the head body h1, the peripheral edge part is easily displaced backward. The deformation of the face part Fp1 increases rebound performance. In the head 2, a peripheral edge part of the face surface f1 has excellent rebound performance.

In respect of the rebound performance of the face peripheral edge part, 50% or greater of the peripheral edge f21 (peripheral edge f20) is preferably separated from the head body h1; 70% or greater of the peripheral edge f21 (peripheral edge f20) is more preferably separated from the head body h1; 90% or greater of the peripheral edge f21 (peripheral edge f20) is still more preferably separated from the head body h1; and 100% of the peripheral edge f21 (peripheral edge f20) is yet still more preferably separated from the head body h1. In the head 2, 100% of the peripheral edge f21 (peripheral edge f20) is separated from the head body h1.

In the head 2, the connecting part Cn1 is provided only in the face middle region R1. The connecting part Cn1 is not present in the face peripheral region R2. The whole face peripheral region R2 is not backed up. In the whole face peripheral region R2, the clearance g1 is present on the back side of the face part Fp1. Therefore, the face peripheral region R2 has high rebound performance.

As shown in FIGS. 4 and 5, the face part Fp1 is solid. Even if the face part Fp1 is thin, the solid face part Fp1 has an excellent strength. The solid face part Fp1 has an excellent strength even if the backup region B1 is small. The backup region B1 will be described below.

As shown in FIGS. 4 and 5, the face peripheral region R2 of the face part Fp1 is solid. Even if the face peripheral region R2 is thin, the solid face peripheral region R2 has an excellent strength. The solid face peripheral region R2 has excellent durability. The face peripheral region R2 has excellent durability against large deformation.

In the head 2, an average CT value (CT2) in the face peripheral region R2 is greater than an average CT value (CT1) in the face middle region R1. That is, the following relational formula (1) is realized. In the head 2, the peripheral edge part of the face surface f1 has excellent rebound performance.

$$CT2>CT1 \quad (1)$$

In the head 2, an average CT value (CT4) in the middle outer side region R4 is greater than an average CT value (CT3) in the middle inner side region R3. That is, the following relational formula (2) is realized. A sweet spot of the head 2 is large.

$$CT4>CT3 \quad (2)$$

In the head 2, an average CT value (CT5) in the peripheral inner side region R5 is greater than an average CT value (CT4) in the middle outer side region R4. That is, the following relational formula (3) is realized. The sweet spot of the head 2 is large. In the head 2, the peripheral edge part has excellent rebound performance.

$$CT5>CT4 \quad (3)$$

In the head 2, an average CT value (CT6) in the peripheral outer side region R6 is greater than an average CT value (CT5) in the peripheral inner side region R5. That is, the following relational formula (4) is realized. In the head 2, the peripheral edge part has excellent rebound performance.

$$CT6>CT5 \quad (4)$$

In the head 2, an average CT value (CT6) in the peripheral outer side region R6 is greater than an average CT value (CT3) in the middle inner side region R3. That is, the following relational formula (5) is realized. In the head 2, the peripheral edge part has excellent rebound performance.

$$CT6>CT3 \quad (5)$$

As described above, in the head 2, the clearance g1 is provided between the whole peripheral edge f21 and the head body h1. Therefore, the high rebound performance is achieved in the whole peripheral edge part of the face surface f1. As shown in FIGS. 4 and 5, the average thickness of the face peripheral region R2 is smaller than the average thickness of the face middle region R1. The thin face peripheral region R2 facilitates the deformation of the face peripheral region R2. The thin face peripheral region R2 increases the rebound performance of a face peripheral part.

Second Embodiment

Figure 8:
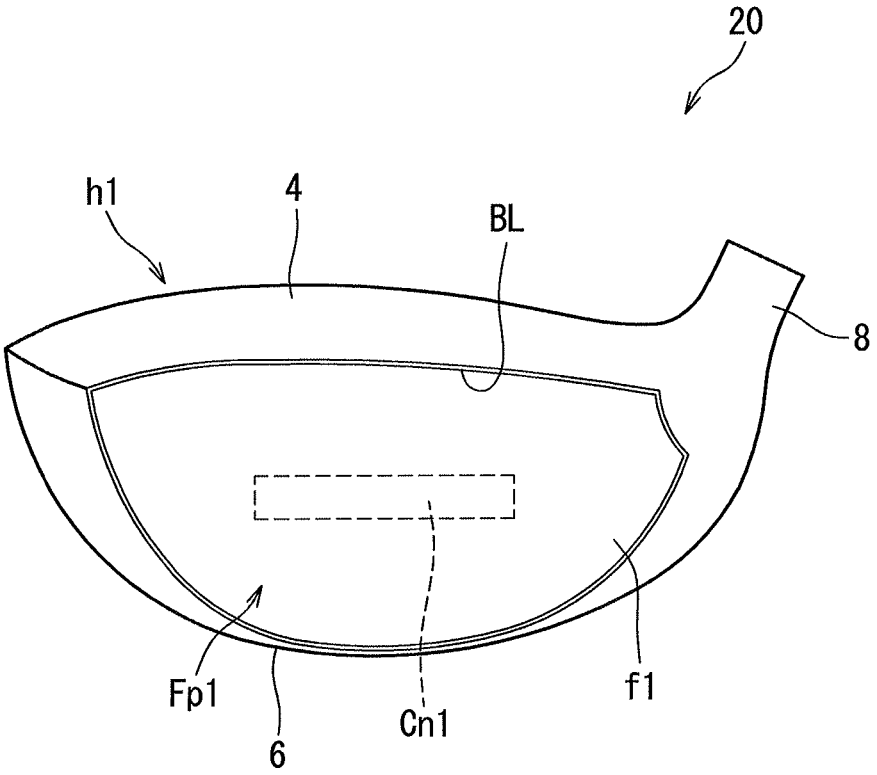
FIG. 8 is a front view of a head according to a second embodiment.
Figure 9:
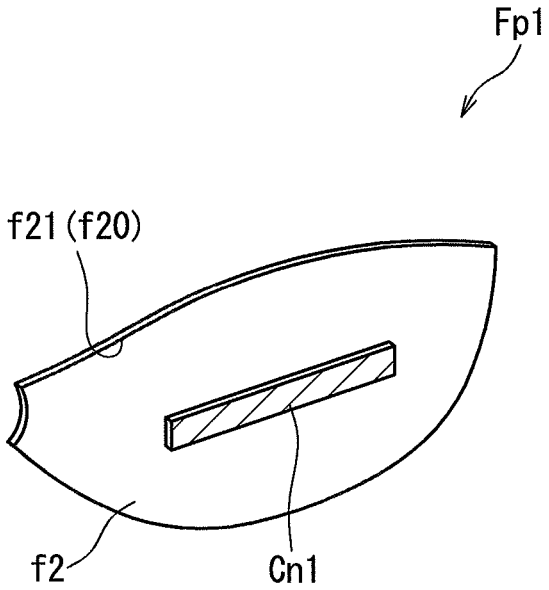
FIG. 9 is a perspective view of a face part used for the head of FIG. 8.

FIG. 8 is a front view of a head 20 according to a second embodiment. FIG. 9 is a perspective view of a face part Fp1 used for the head 20. FIG. 9 is a perspective view of the face part Fp1 viewed from a back side. A connecting part Cn1 connected to the face part Fp1 is also shown in FIG. 9.

The head 20 includes a head body h1, a face part Fp1, and a connecting part Cn1. The connecting part Cn1 connects the head body h1 and the face part Fp1 to each other. The face part Fp1 is connected to the head body h1 by only the connecting part Cn1. The head body h1 includes a crown 4, a sole 6, and a hosel 8. The inside of the head body h1 is a space. The head 20 is a hollow head.

In the head 20, a peripheral edge f21 (peripheral edge f20) is separated from the head body h1. The whole peripheral edge f21 (peripheral edge f20) is separated from the head body h1. The peripheral edge f21 (peripheral edge f20) is separated from a front part Fb1. A clearance is present between the peripheral edge f21 (peripheral edge f20) and the head body h1. In the whole peripheral edge f21 (peripheral edge f20), the clearance is present between the peripheral edge f21 and the head body h1. The clearance easily causes the displacement of the peripheral edge f21. The clearance easily causes the deformation of a face surface f1 in hitting. A peripheral edge part of the face part Fp1 has a high degree of freedom of deformation. The peripheral edge part of the face part Fp1 is once displaced backward by the deformation, and then returned to the front. The deformation of the face part Fp1 increases rebound performance. In the head 20, a peripheral edge part of the face surface f1 has excellent rebound performance.

The difference between the above-mentioned head 2 and the head 20 is only the connecting part Cn1.

The connecting part Cn1 is disposed substantially at the middle of the face part Fp1. In the planar view, the center of gravity of the connecting part Cn1 is located in a face middle region R1. In the planar view, the center of gravity of the connecting part Cn1 is located in a middle inner side region R3. In the planar view, the presence region of the connecting part Cn1 includes a face center Fc.

In the head 20, the connecting part Cn1 has an oblong shape. The length of the connecting part Cn1 in a toe-heel direction is greater than the length of the connecting part Cn1 in an up-down direction. The connecting part Cn1 which is longer in the toe-heel direction stably supports the face part Fp1.

The connecting part Cn1 does not inhibit the rebound performance on the lower side of the face surface f1. In the head 20, the rebound performance on the lower side of the face surface f1 is high. The connecting part Cn1 does not inhibit the rebound performance on the upper side of the face surface f1. In the head 20, the rebound performance on the upper side of the face surface f1 is high.

Third Embodiment

Figure 10:
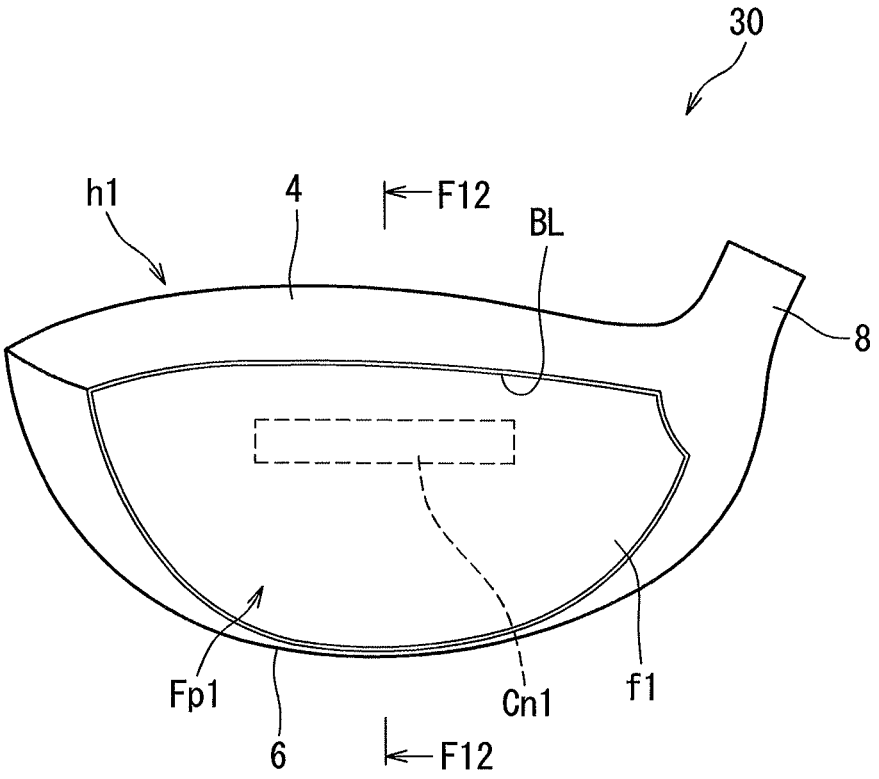
FIG. 10 is a front view of a head according to a third embodiment.
Figure 11:
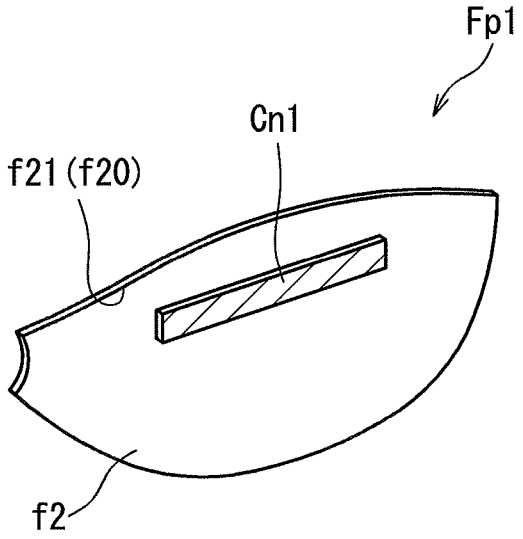
FIG. 11 is a perspective view of a face part used for the head of FIG. 10.
Figure 12:
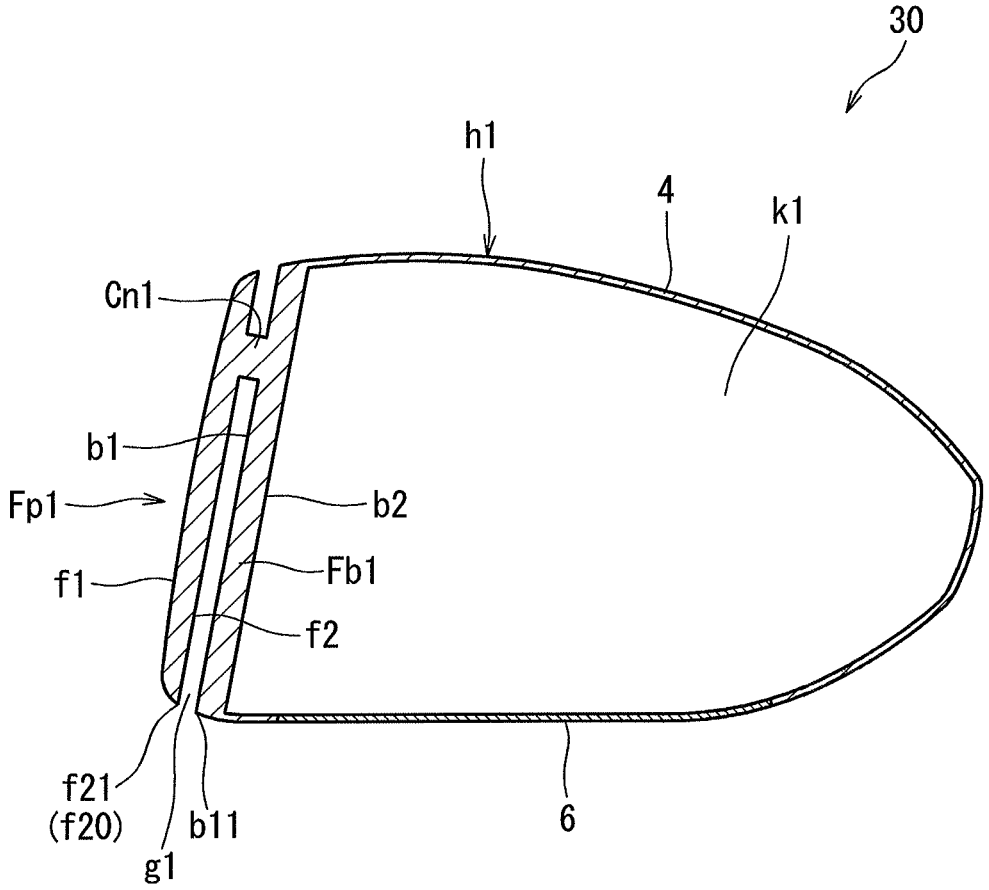
FIG. 12 is a cross-sectional view taken along line F12-F12 of FIG. 10.

FIG. 10 is a front view of a head 30 according to a third embodiment. FIG. 11 is a perspective view of a face part Fp1 used for the head 30. FIG. 12 is a cross-sectional view taken along line F12-F12 of FIG. 10.

The head 30 includes a head body h1, a face part Fp1, and a connecting part Cn1. The connecting part Cn1 connects the head body h1 and the face part Fp1 to each other. The face part Fp1 is connected to the head body h1 by only the connecting part Cn1. The head body h1 includes a crown 4, a sole 6, and a hosel 8. The inside of the head body h1 is a space. As shown in FIG. 12, the head body h1 includes a cavity part k1. The head 30 is a hollow head.

In the head 30, a peripheral edge f21 of a face back surface f2 is separated from the head body h1. The whole peripheral edge f21 is separated from the head body h1. The peripheral edge f21 is separated from a front part Fb1. A clearance g1 is present between the peripheral edge f21 and the head body h1. In the whole peripheral edge f21, the clearance g1 is present between the peripheral edge f21 and the head body h1. The clearance g1 easily causes the displacement of the peripheral edge f21. A face surface f1 is easily deformed in hitting. A peripheral edge part of the face part Fp1 has a high degree of freedom of deformation. In the head 30, a peripheral edge part of the face surface f1 has excellent rebound performance.

The difference between the above-mentioned head 2 and the head 30 is only the connecting part Cn1.

The connecting part Cn1 is disposed on the upper side of the face part Fp1. In the planar view, the presence region of the connecting part Cn1 does not include a face center Fc. In the planar view, the center of gravity of the connecting part Cn1 is located in the upper region. In the planar view, the center of gravity of the connecting part Cn1 is located in a face peripheral region R2. In the planar view, the center of gravity of the connecting part Cn1 is located in the peripheral inner side region R5. In the planar view, the upper region includes the whole connecting part Cn1.

In the head 30, the connecting part Cn1 has an oblong shape. The length of the connecting part Cn1 in a toe-heel direction is greater than the length of the connecting part Cn1 in an up-down direction. The strength of the connecting part Cn1 is improved by increasing the length of the connecting part Cn1 in the toe-heel direction.

Since the connecting part Cn1 is disposed on the upper side, the displacement on the lower side of the face surface f1 is large. That is, the connecting part Cn1 disposed on the upper side allows large displacement on the lower side of the face surface f1. The connecting part Cn1 can effectively increase rebound performance on the lower side of the face surface f1. In the head 30, the rebound performance on the lower side of the face surface f1 is high.

The disposal of the connecting part Cn1 is not limited. For example, contrary to the head 30, the connecting part Cn1 may be disposed on the lower side. For example, the whole connecting part Cn1 may be disposed in the lower region. The connecting part Cn1 disposed on the lower side allows large displacement on the upper side of the face surface f1. The connecting part Cn1 can effectively increase rebound performance on the upper side of the face surface f1. The large displacement on the upper side of the face surface f1 increases a loft angle. Therefore, a high launch angle can be achieved. The high launch angle contributes to an increase in a flight distance.

Fourth Embodiment

Figure 13:
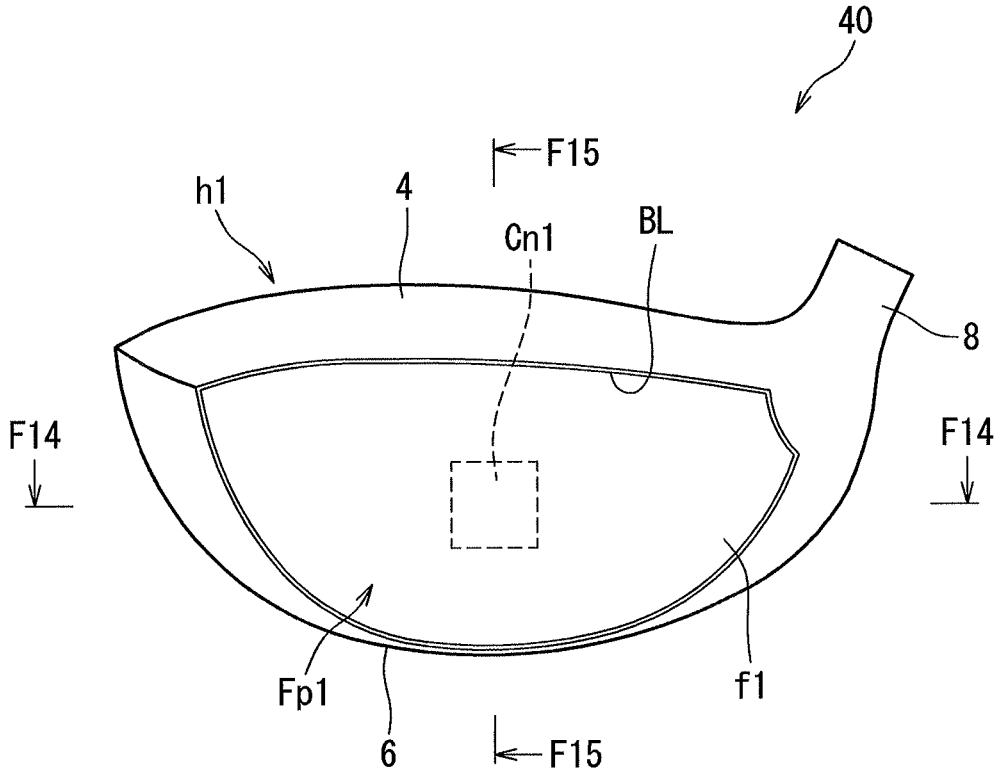
FIG. 13 is a front view of a head according to a fourth embodiment.
Figure 14:
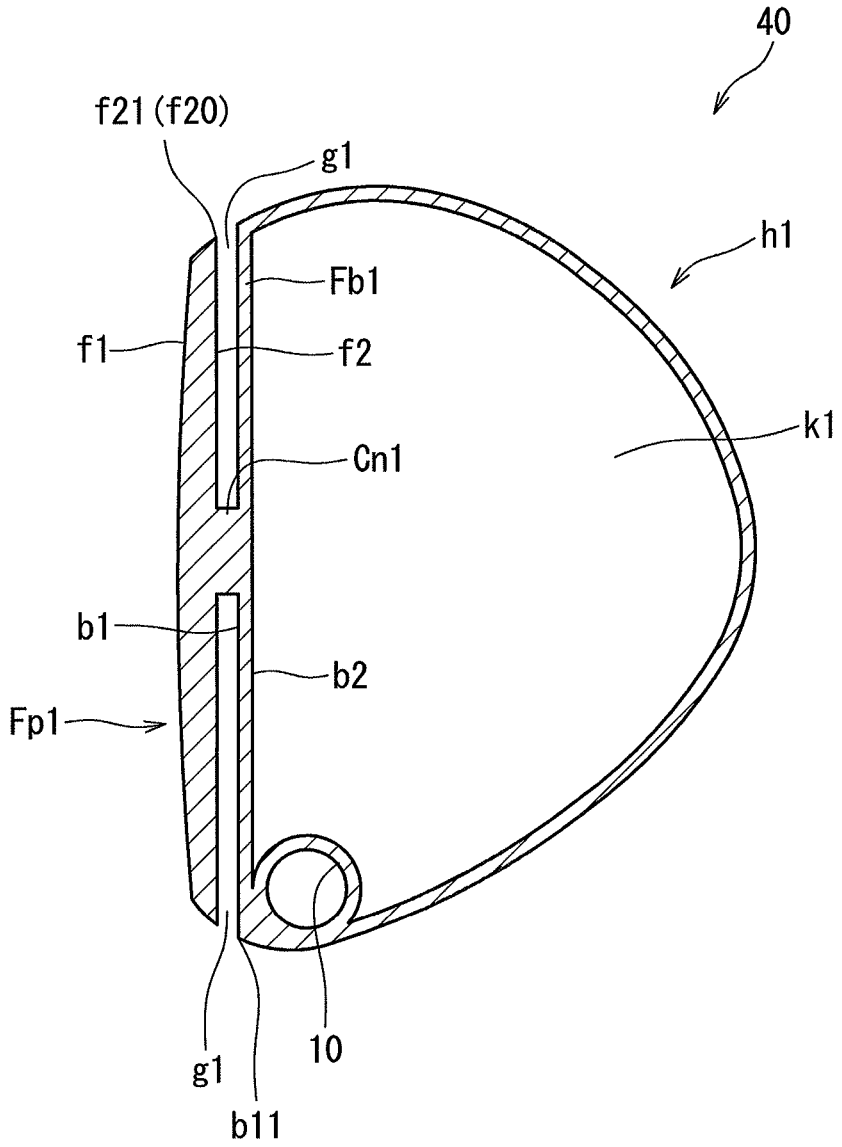
FIG. 14 is a cross-sectional view taken along line F14-F14 of FIG. 13.
Figure 15:
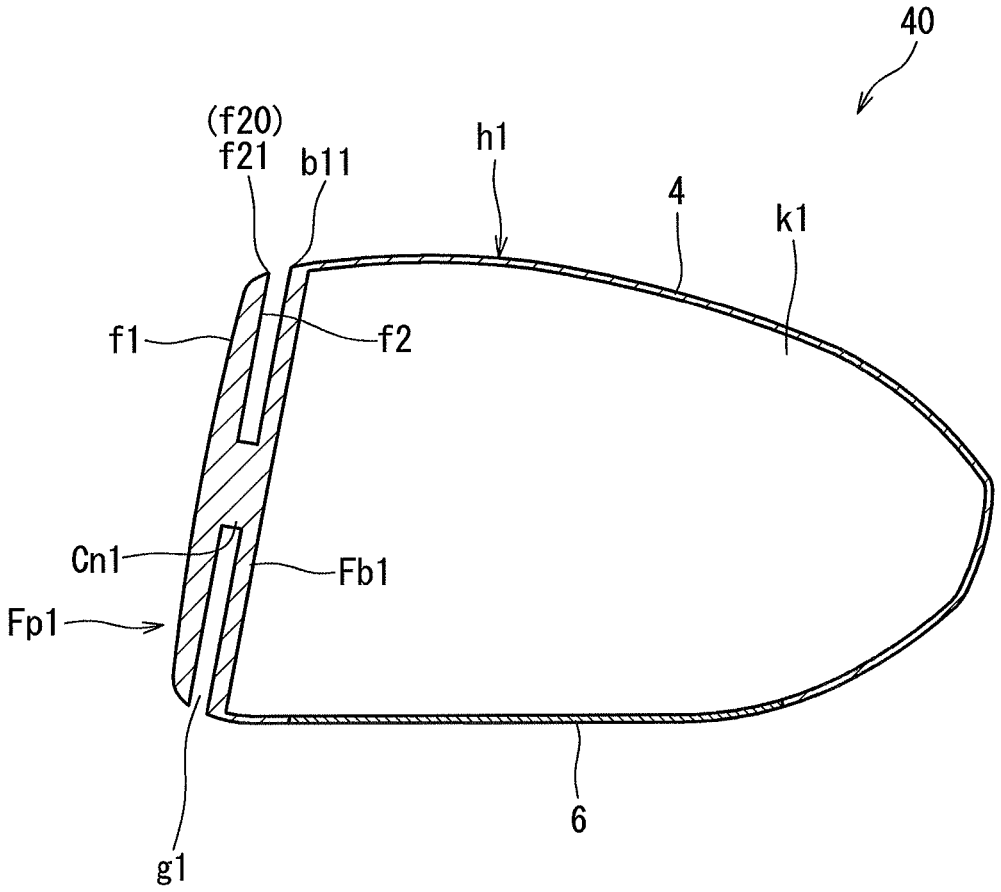
FIG. 15 is a cross-sectional view taken along line F15-F15 of FIG. 13.

FIG. 13 is a front view of a head 40 according to a fourth embodiment. FIG. 14 is a cross-sectional view taken along line F14-F14 of FIG. 13. FIG. 15 is a cross-sectional view taken along line F15-F15 of FIG. 13.

The head 40 includes a head body h1, a face part Fp1, and a connecting part Cn1. The connecting part Cn1 connects the head body h1 and the face part Fp1 to each other. The face part Fp1 is connected to the head body h1 by only the connecting part Cn1. The head body h1 includes a crown 4, a sole 6, and a hosel 8. The hosel 8 includes a hosel hole 10. The inside of the head body h1 is a space. As shown in FIGS. 14 and 15, the head body h1 includes a cavity part k1. The head 40 is a hollow head.

In the head 40, a peripheral edge f21 of a face back surface f2 is separated from the head body h1. The whole peripheral edge f21 is separated from the head body h1. The peripheral edge f21 is separated from a front part Fb1. A clearance g1 is present between the peripheral edge f21 and the head body h1. In the whole peripheral edge f21, the clearance g1 is present between the peripheral edge f21 and the head body h1. The clearance g1 easily causes the displacement of the peripheral edge f21. A face surface f1 is easily deformed in hitting. A peripheral edge part of the face part Fp1 has a high degree of freedom of deformation. The deformation of the face part Fp1 increases rebound performance. In the head 40, a peripheral edge part of the face surface f1 has excellent rebound performance.

The difference between the above-mentioned head 2 and the head 40 is only the thickness of the front part Fb1. In the head 40, the front part Fb1 is thin.

In hitting, in addition to the face part Fp1, the front part Fb1 can also be deformed. That is, in hitting, the front part Fb1 is deflected. The thin front part Fb1 can be easily deformed. In hitting, a middle part of the front part Fb1 is once displaced backward, and then returned to the front. The deformation of the front part Fb1 contributes to an improvement in rebound performance.

On the face surface f1, displacement A caused by the separation of the face surface f1 from the head body h1 and displacement B caused by the deformation of the front part Fb1 are generated. A synergistic effect is exhibited by the displacement A and the displacement B. The synergistic effect increases the rebound performance. The synergistic effect achieves both the rebound performance of a face middle region R1 and the rebound performance of a face peripheral region R2. The synergistic effect can increase the rebound performance of the whole face surface f1.

Although the displacement A is not generated in a portion backed up by the connecting part Cn1, the displacement B is generated. The displacement B increases the rebound performance of a backup region B1 (described below).

The connecting part Cn1 is disposed substantially at the middle of the face part Fp1. In the planar view, the center of gravity of the connecting part Cn1 is located in the face middle region R1. In the planar view, the center of gravity of the connecting part Cn1 is located in a middle inner side region R3. In the planar view, the presence region of the connecting part Cn1 includes a face center Fc.

The deformation of the front part Fb1 compensates the decrease in the rebound performance caused by the absence of the clearance g1. The rebound performance of a region in which the connecting part Cn1 is present is increased by the deformation of the front part Fb1.

In respect of increasing the rebound performance, the thickness of the front part Fb1 is preferably equal to or less than 5 mm, more preferably equal to or less than 4 mm, still more preferably equal to or less than 3 mm, yet still more preferably equal to or less than 2.8 mm, even yet still more preferably equal to or less than 2.6 mm, even yet still more preferably equal to or less than 2.4 mm, even yet still more preferably equal to or less than 2.2 mm, and even yet still more preferably equal to or less than 2 mm. In respect of a strength, the thickness of the front part Fb1 is preferably equal to or greater than 1 mm, more preferably equal to or greater than 1.2 mm, still more preferably equal to or greater than 1.5 mm, yet still more preferably equal to or greater than 1.7 mm, and even yet still more preferably equal to or greater than 1.9 mm.

The front part Fb1 includes a middle part in which an amount of displacement can be large. In respect of the rebound performance, the connecting part Cn1 is preferably located in the middle part of the front part Fb1. In respect of increasing the displacement B, the connecting part Cn1 is preferably located in the middle part. For example, in the planar view, the center of gravity of the connecting part Cn1 is preferably located in the face middle region R1. In the planar view, the center of gravity of the connecting part Cn1 is more preferably located in the middle inner side region R3. In light of the deformation of the front part Fb1, the whole connecting part Cn1 is preferably included in the face middle region R1 in the planar view.

Fifth Embodiment

Figure 16:
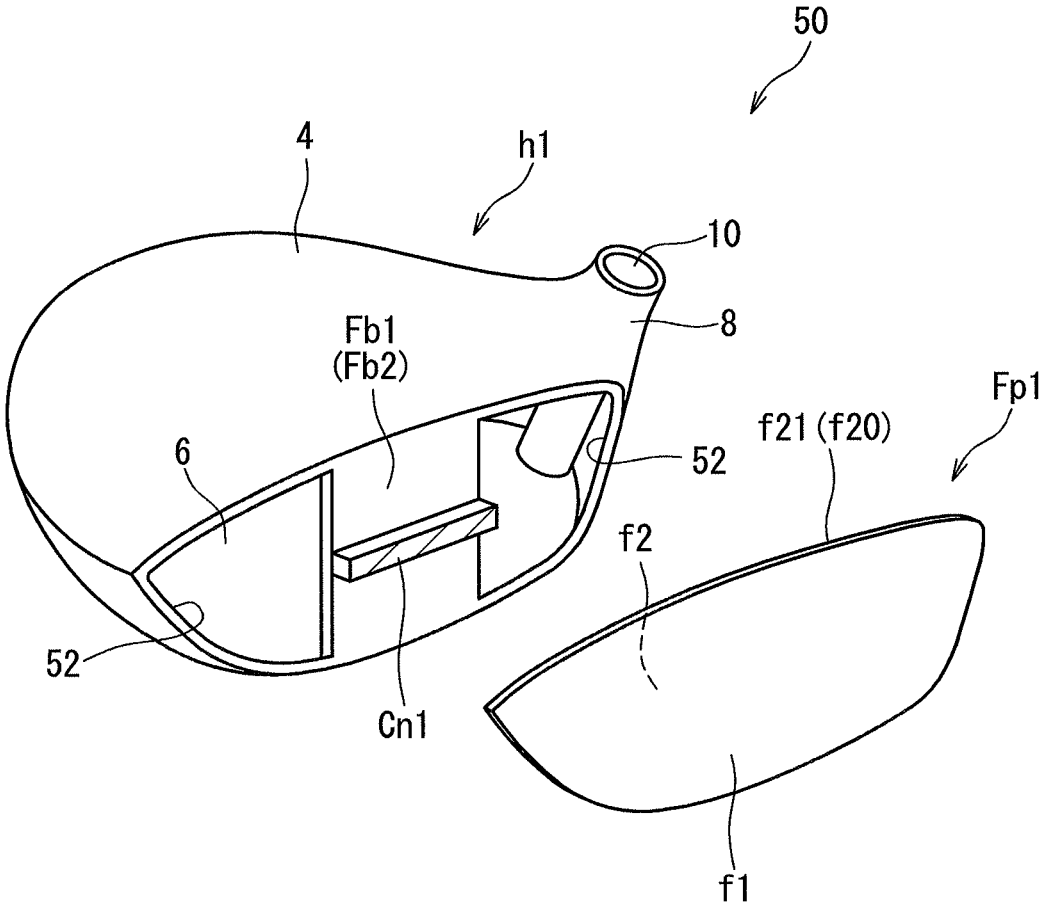
FIG. 16 is an exploded perspective view of a head according to a fifth embodiment.

FIG. 16 is an exploded perspective view of a head 50 according to a fifth embodiment.

The head 50 includes a head body h1, a face part Fp1, and a connecting part Cn1. The connecting part Cn1 connects the head body h1 and the face part Fp1 to each other. The face part Fp1 is connected to the head body h1 by only the connecting part Cn1. The head body h1 includes a crown 4, a sole 6, and a hosel 8. The hosel 8 includes a hosel hole 10. The inside of the head body h1 is a space. The space is not closed.

In the head 50, a peripheral edge f21 of a face back surface f2 is separated from the head body h1. The whole peripheral edge f21 is separated from the head body h1. The peripheral edge f21 is separated from a front part Fb1. A clearance is present between the peripheral edge f21 and the head body h1. In the whole peripheral edge f21, the clearance is present between the peripheral edge f21 and the head body h1. The clearance easily causes the displacement of the peripheral edge f21. A face surface f1 is easily deformed in hitting. The deformation of the face part Fp1 increases rebound performance. In the head 50, a peripheral edge part of the face surface f1 has excellent rebound performance.

The connecting part Cn1 of the head 50 is the same as the connecting part Cn1 of the above-mentioned head 20. The difference between the head 50 and the head 20 exists in the front part Fb1. In the head 20, the front part Fb1 blocks the whole front of a cavity part k1. Meanwhile, in the head 50, the front part Fb1 shields a part of a front of the cavity part k1. As shown in FIG. 16, an opening 52 is formed in the head body h1. A portion in which the front part Fb1 is not present forms the opening 52. The opening 52 is formed by the lack of the front part Fb1. In FIG. 16, under the presence of the opening 52, the inside of the head body h1 is viewable.

Thus, the front part Fb1 of the head 50 is a partial front part Fb2 shielding a part of a front of the cavity part of the head body h1. The partial front part Fb2 connects an upper part (crown 4) of the head body h1 and a lower part (sole 6) of the head body h1 to each other. The partial front part Fb2 is not connected to a toe portion of the head body h1. The partial front part Fb2 is not connected to a heel portion of the head body h1. The cavity part k1 is present behind the partial front part Fb2. The partial front part Fb2 is easily deformed. In hitting, the amount of deformation of the partial front part Fb2 is large. The partial front part Fb2 contributes to an improvement in rebound performance.

The partial front part Fb2 connects the crown 4 and the sole 6 to each other. The partial front part Fb2 extends to the sole 6 from the crown 4. The crown 4 is comparatively thin. For example, the thickness of the crown 4 is 0.5 mm or greater and 2.0 mm or less. The thin crown 4 is likely to be deformed. For this reason, the deformability of the partial front part Fb2 is further increased.

The head 50 includes a first opening 52 provided on the toe side of the front part Fb1 and a second opening 52 provided on the heel side of the front part Fb1. These openings 52 decrease the restraint to the front part Fb1. The front part Fb1 is easily deformed. In the head 50, a face middle region R1 also has high rebound performance.

Sixth to Twelfth Embodiments: Fairway Woods

Figure 17:
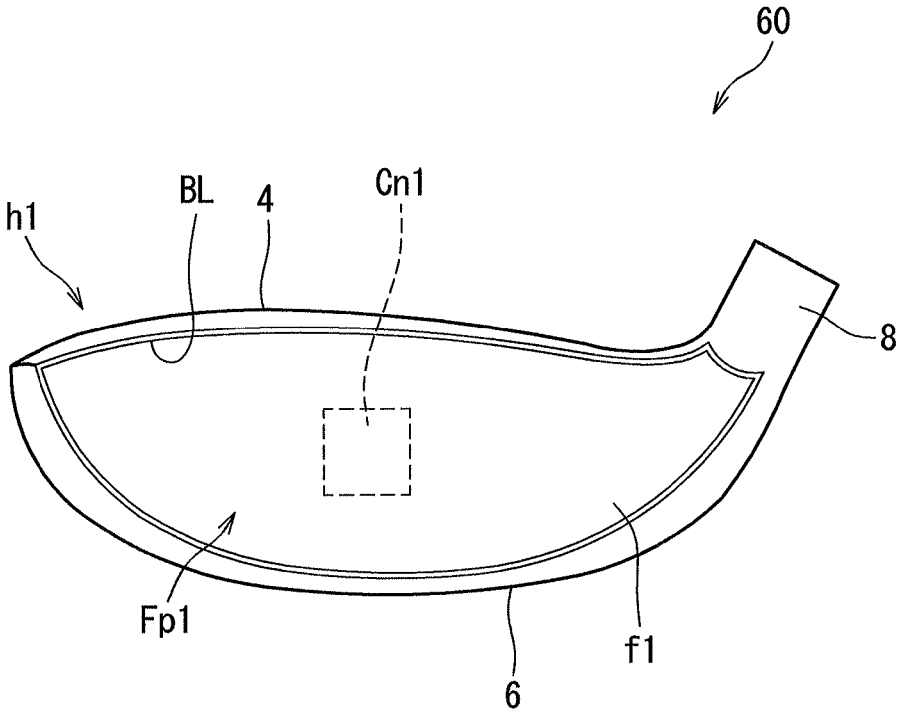
FIG. 17 is a front view of a head according to a sixth embodiment.

FIG. 17 is a front view of a head 60 according to a sixth embodiment. The head 60 is a fairway wood.

The head 60 includes a head body h1, a face part Fp1, and a connecting part Cn1. The connecting part Cn1 connects the head body h1 and the face part Fp1 to each other. The face part Fp1 is connected to the head body h1 by only the connecting part Cn1. The head body h1 includes a crown 4, a sole 6, and a hosel 8. The hosel 8 includes a hosel hole. The head body h1 includes a cavity part. The head 60 is a hollow head. The head body h1 includes a front part disposed in front of the cavity part.

In the head 60, a peripheral edge of a face back surface is separated from the head body h1. The whole peripheral edge of the face back surface is separated from the head body h1. The peripheral edge is separated from the front part. A clearance is present between the peripheral edge and the head body h1. The clearance can easily cause the displacement of the peripheral edge of the face back surface. A face surface f1 is easily deformed in hitting. The deformation of the face part Fp1 increases rebound performance. In the head 60, a peripheral edge part of the face surface f1 has excellent rebound performance.

The connecting part Cn1 is disposed substantially at the middle of the face part Fp1. In the planar view, the center of gravity of the connecting part Cn1 is located in a face middle region R1. In the planar view, the center of gravity of the connecting part Cn1 is located in a middle inner side region R3. In the planar view, the presence region of the connecting part Cn1 includes a face center Fc.

As in the above-mentioned head 2, the head 60 satisfies the following formula (1). In the head 60, a peripheral edge part of the face surface f1 has excellent rebound performance.

$$CT2>CT1 \quad (1)$$

As in the above-mentioned head 2, the head 60 satisfies the following relational formula (2). A sweet spot of the head 60 is large.

$$CT4>CT3 \quad (2)$$

As in the above-mentioned head 2, the head 60 satisfies the following relational formula (3). A sweet spot of the head 2 is large. In the head 60, the peripheral edge part has excellent rebound performance.

$$CT5>CT4 \quad (3)$$

As in the above-mentioned head 2, the head 60 satisfies the following relational formula (4). In the head 60, the peripheral edge part has excellent rebound performance.

$$CT6>CT5 \quad (4)$$

A ball which is not teed up is often hit by the fairway wood. In the fairway wood, a ball is often hit on the lower side of the face surface f1. The clearance easily causes the displacement of the lower edge of the face surface f1 in the head 60. In the head 60, the lower edge part of the face surface f1 has high rebound performance. The structure of the head 60 is suitable for the fairway wood. The structure of the head 60 is suitable for a utility wood. The structure of the head 60 is suitable for a hybrid wood.

Figure 18:
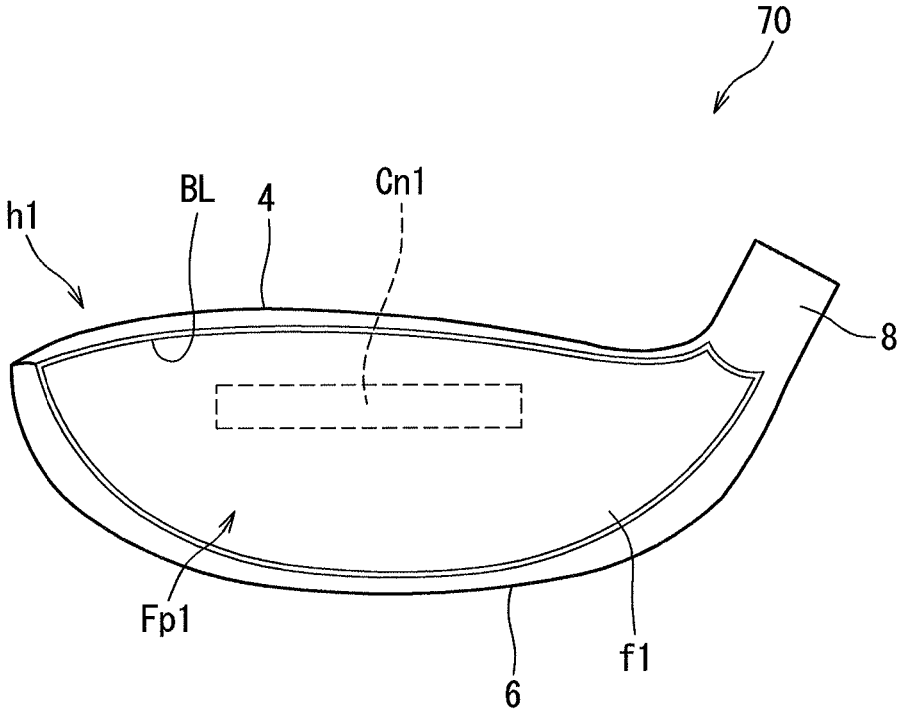
FIG. 18 is a front view of a head according to a seventh embodiment.

FIG. 18 is a front view of a head 70 according to a seventh embodiment. The head 70 is a fairway wood.

The head 70 includes a head body h1, a face part Fp1, and a connecting part Cn1. The connecting part Cn1 connects the head body h1 and the face part Fp1 to each other. The face part Fp1 is connected to the head body h1 by only the connecting part Cn1. The head body h1 includes a crown 4, a sole 6, and a hosel 8. The hosel 8 includes a hosel hole. The head body h1 includes a cavity part. The head 70 is a hollow head. The head body h1 includes a front part disposed in front of the cavity part.

In the head 70, a peripheral edge of a face back surface is separated from the head body h1. The whole peripheral edge of the face back surface is separated from the head body h1. The peripheral edge is separated from the front part. A clearance is present between the peripheral edge and the head body h1. The clearance can easily cause the displacement of the peripheral edge of the face back surface. The clearance easily causes the deformation of a face surface f1 in hitting.

The connecting part Cn1 is disposed on the upper side of the face part Fp1. In the planar view, the whole connecting part Cn1 is included in the upper side region. In the planar view, the presence region of the connecting part Cn1 does not include a face center Fc.

As in the above-mentioned head 30, in the head 70, a lower edge part of the face surface f1 can be largely displaced. In the head 70, the lower edge part of the face surface f1 has particularly high rebound performance. The structure of the head 70 is particularly suitable for the fairway wood. Similarly, the structure of the head 70 is suitable also for a utility wood and a hybrid wood.

Figure 19:
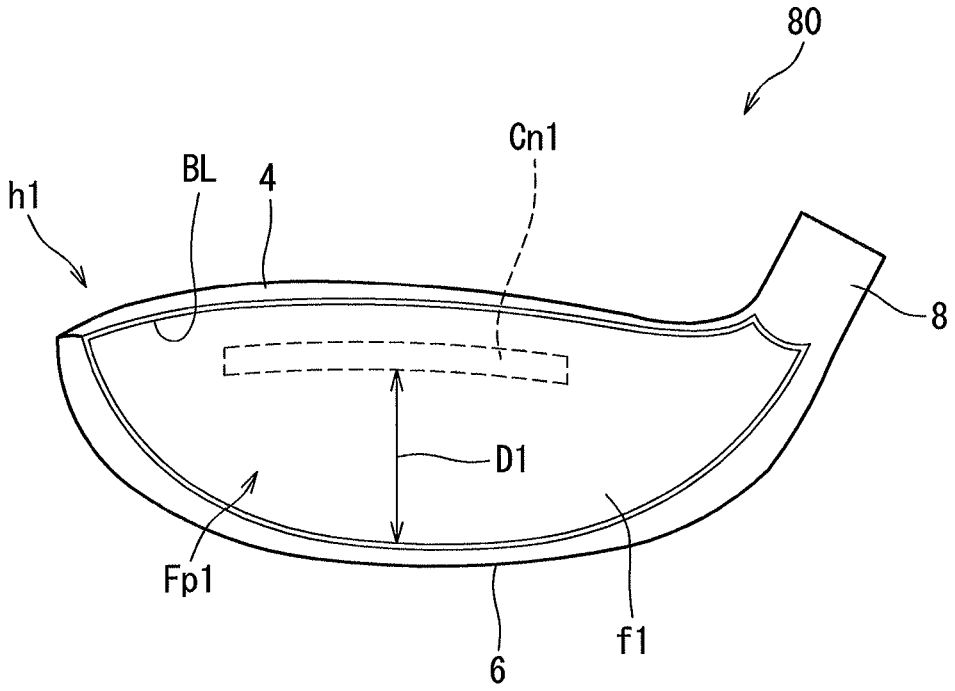
FIG. 19 is a front view of a head according to an eighth embodiment.

FIG. 19 is a front view of a head 80 according to an eighth embodiment. The head 80 is a fairway wood.

The head 80 includes a head body h1, a face part Fp1, and a connecting part Cn1. The connecting part Cn1 connects the head body h1 and the face part Fp1 to each other. The face part Fp1 is connected to the head body h1 by only the connecting part Cn1. The head body h1 includes a crown 4, a sole 6, and a hosel 8. The hosel 8 includes a hosel hole. The head body h1 includes a cavity part. The head 80 is a hollow head. The head body h1 includes a front part disposed in front of the cavity part.

In the head 80, a peripheral edge of a face back surface is separated from the head body h1. The whole peripheral edge of the face back surface is separated from the head body h1. The peripheral edge is separated from the front part. A clearance is present between the peripheral edge and the head body h1. The clearance can easily cause the displacement of the peripheral edge of the face back surface. The clearance easily causes the deformation of a face surface f1 in hitting. A peripheral edge part of the face part Fp1 has a high degree of freedom of deformation. In the head 80, a peripheral edge part of the face surface f1 has excellent rebound performance.

The connecting part Cn1 is disposed on the upper side of the face part Fp1. In the planar view, the whole connecting part Cn1 is included in the upper side region. In the planar view, the presence region of the connecting part Cn1 does not include a face center Fc.

As in the above-mentioned head 30, in the head 80, a lower edge part of the face surface f1 can be largely displaced. In the head 80, the lower edge part of the face surface f1 has particularly high rebound performance. The structure of the head 80 is particularly suitable for the fairway wood. Similarly, the structure of the head 80 is suitable also for a utility wood and a hybrid wood.

In the head 80, the connecting part Cn1 extends in a curved state. In the planar view, the curve is convexed to the upper side. A distance in an up-down direction between the lower edge of the face back surface and the connecting part Cn1 is shown by a double-headed arrow D1 in FIG. 19. The curve can cause an increase in the distance D1 in a middle part of the face surface f1. Therefore, the rebound performance of the middle part of the face surface f1 can be improved.

Figure 20:
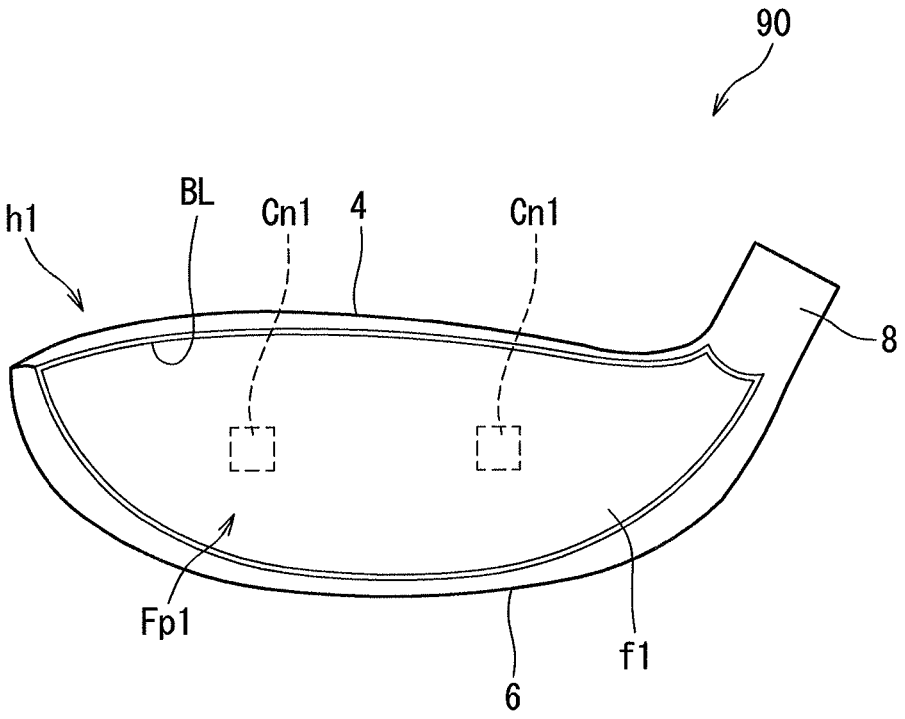
FIG. 20 is a front view of a head according to a ninth embodiment.

FIG. 20 is a front view of a head 90 according to a ninth embodiment. The head 90 is a fairway wood.

The head 90 includes a head body h1, a face part Fp1, and a connecting part Cn1. A plurality of connecting parts Cn1 are provided. The two connecting parts Cn1 connect the head body h1 and the face part Fp1 to each other. The face part Fp1 is connected to the head body h1 by only these connecting parts Cn1. The head body h1 includes a crown 4, a sole 6, and a hosel 8. The hosel 8 includes a hosel hole. The head body h1 includes a cavity part. The head 90 is a hollow head. The head body h1 includes a front part disposed in front of the cavity part.

In the head 90, a peripheral edge of a face back surface is separated from the head body h1. The whole peripheral edge of the face back surface is separated from the head body h1. The peripheral edge is separated from the front part. A clearance is present between the peripheral edge and the head body h1. The clearance can easily cause the displacement of the peripheral edge of the face back surface. The clearance easily causes the deformation of a face surface f1 in hitting. A peripheral edge part of the face part Fp1 has a high degree of freedom of deformation.

A first connecting part Cn1 is disposed in a toe region. A second connecting part Cn1 is disposed in a heel region. The plurality of connecting parts Cn1 can stably support the face part Fp1. If the number of the connecting parts Cn1 is plural, the size of each connecting part Cn1 can be reduced. Therefore, a nonbackup region N1 (described below) can be increased. Furthermore, if the number of the connecting parts Cn1 is plural, the degree of freedom of disposal of the connecting parts Cn1 is increased. Therefore, the durability of the head can be increased while a backup region B1 (described below) is suppressed.

Figure 21:
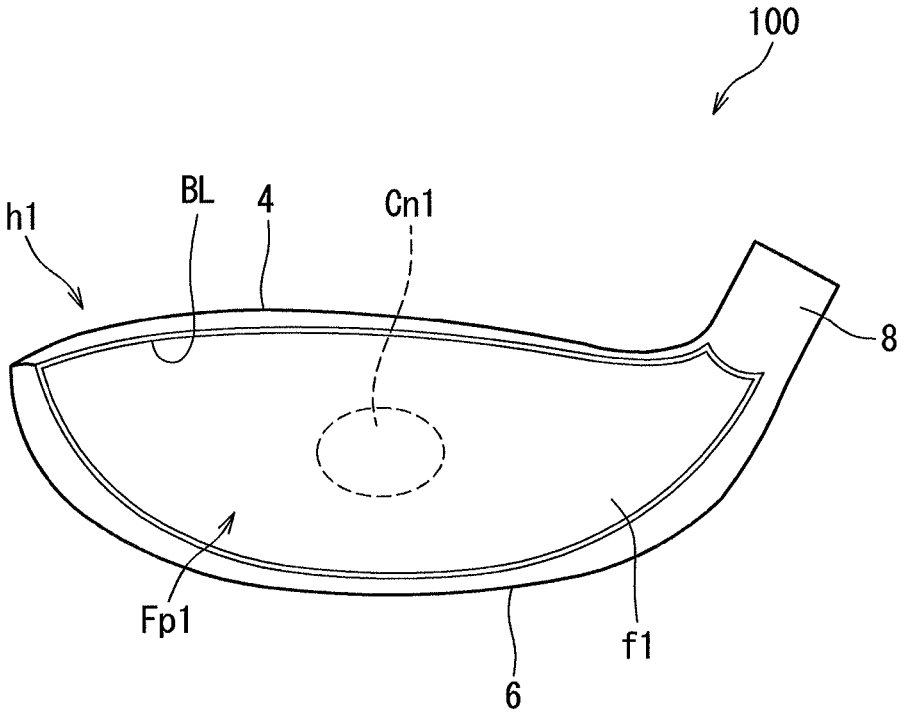
FIG. 21 is a front view of a head according to a tenth embodiment.

FIG. 21 is a front view of a head 100 according to a tenth embodiment. The head 100 is a fairway wood.

The head 100 includes a head body h1, a face part Fp1, and a connecting part Cn1. The connecting part Cn1 connects the head body h1 and the face part Fp1 to each other. The face part Fp1 is connected to the head body h1 by only the connecting part Cn1. The head body h1 includes a crown 4, a sole 6, and a hosel 8. The hosel 8 includes a hosel hole. The head body h1 includes a cavity part. The head 100 is a hollow head. The head body h1 includes a front part disposed in front of the cavity part.

In the head 100, a peripheral edge of a face back surface is separated from the head body h1. The whole peripheral edge of the face back surface is separated from the head body h1. The peripheral edge is separated from the front part. A clearance is present between the peripheral edge and the head body h1. The clearance can easily cause the displacement of the peripheral edge of the face back surface. A face surface f1 is easily deformed in hitting. A peripheral edge part of the face part Fp1 has a high degree of freedom of deformation. In the head 100, a peripheral edge part of the face surface f1 has excellent rebound performance.

In the planar view, the connecting part Cn1 has an elliptical shape. In the planar view, the border line of the connecting part Cn1 is constituted by only a curve. The border constituted by the curve can mitigate stress concentration in the border. The mitigation can contribute to an improvement in durability. The size of the connecting part Cn1 in a toe-heel direction is greater than the size of the connecting part Cn1 in an up-down direction. Therefore, the face surface f1 can be stably supported.

Figure 22:
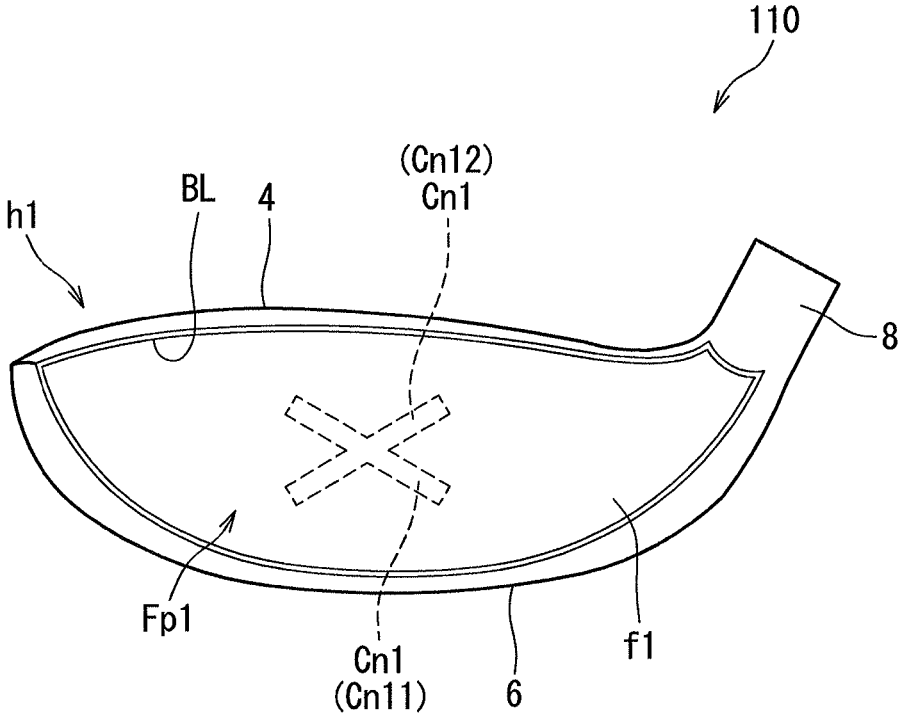
FIG. 22 is a front view of a head according to an eleventh embodiment.

FIG. 22 is a front view of a head 110 according to an eleventh embodiment. The head 110 is a fairway wood.

The head 110 includes a head body h1, a face part Fp1, and a connecting part Cn1. The connecting part Cn1 connects the head body h1 and the face part Fp1 to each other. The face part Fp1 is connected to the head body h1 by only the connecting part Cn1. The head body h1 includes a crown 4, a sole 6, and a hosel 8. The hosel 8 includes a hosel hole. The head body h1 includes a cavity part. The head 110 is a hollow head. The head body h1 includes a front part disposed in front of the cavity part.

In the head 110, a peripheral edge of a face back surface is separated from the head body h1. The whole peripheral edge of the face back surface is separated from the head body h1. The peripheral edge is separated from the front part. A clearance is present between the peripheral edge and the head body h1. The clearance can easily cause the displacement of the peripheral edge of the face back surface. A face surface f1 is easily deformed in hitting. A peripheral edge part of the face part Fp1 has a high degree of freedom of deformation. In the head 110, a peripheral edge part of the face surface f1 has excellent rebound performance.

In the planar view, the connecting part Cn1 has an X character shape. The connecting part Cn1 includes a first extending part Cn11 inclined so that it go to an upper side toward a toe side, and a second extending part Cn12 inclined so that it go to an upper side toward a heel side. The first extending part Cn11 and the second extending part Cn12 cross each other. The connecting part Cn1 can stably support the face part Fp1. The connecting part Cn1 has an excellent balance between a large high restitution region and high durability.

Figure 23:
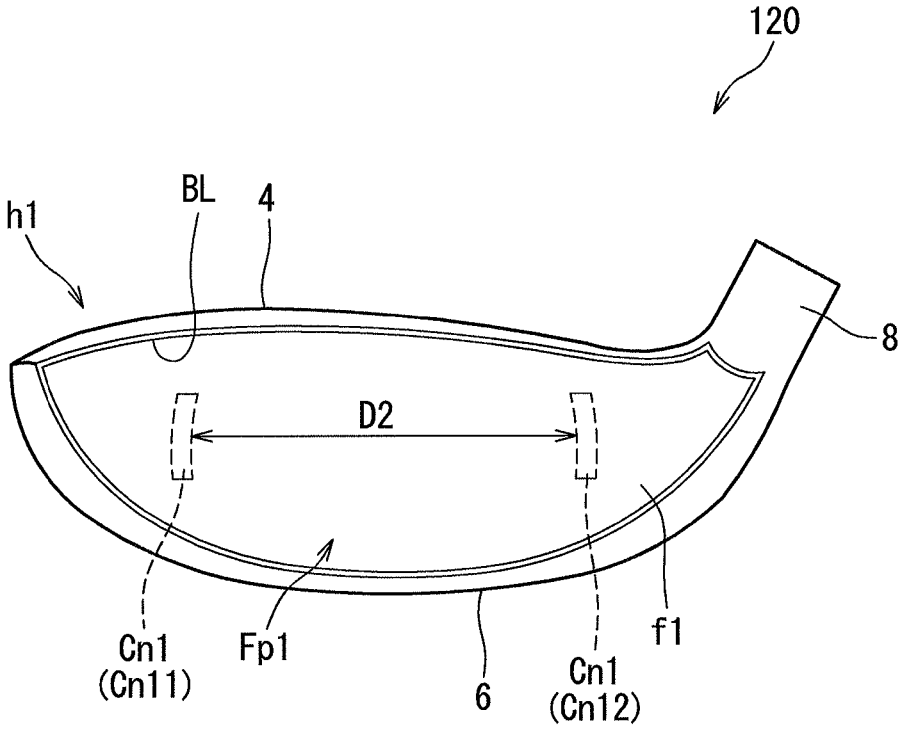
FIG. 23 is a front view of a head according to a twelfth embodiment.

FIG. 23 is a front view of a head 120 according to a twelfth embodiment. The head 120 is a fairway wood.

The head 120 includes a head body h1, a face part Fp1, and a connecting part Cn1. A plurality of connecting parts Cn1 are provided. The two connecting parts Cn1 connect the head body h1 and the face part Fp1 to each other. The face part Fp1 is connected to the head body h1 by only these connecting parts Cn1. The head body h1 includes a crown 4, a sole 6, and a hosel 8. The hosel 8 includes a hosel hole. The head body h1 includes a cavity part. The head 120 is a hollow head. The head body h1 includes a front part disposed in front of the cavity part. In the head 120, a peripheral edge of a face back surface is separated from the head body h1. The whole peripheral edge of the face back surface is separated from the head body h1. The peripheral edge is separated from the front part. A clearance is present between the peripheral edge and the head body h1. The clearance can easily cause the displacement of the peripheral edge of the face back surface. A face surface f1 is easily deformed in hitting. A peripheral edge part of the face part Fp1 has a high degree of freedom of deformation. In the head 120, a peripheral edge part of the face surface f1 has excellent rebound performance.

A first connecting part Cn11 is disposed in a toe region. A second connecting part Cn12 is disposed in a heel region. The plurality of connecting parts Cn1 can stably support the face part Fp1. If the number of the connecting parts Cn1 is plural, the size of each connecting part Cn1 can be reduced. Therefore, the region in which the clearance is present can be increased. Furthermore, if the number of the connecting parts Cn1 is plural, the degree of freedom of disposal of the connecting parts Cn1 is increased. Therefore, both a large high restitution region and high durability can be achieved.

In the planar view, the first connecting part Cn11 is curved. The curve is convexed to a toe side. The second connecting part Cn12 is curved in the planar view. The curve is convexed to a heel side. A distance in a toe-heel direction between the first connecting part Cn11 and the second connecting part Cn12 is shown by a double-headed arrow D2 in FIG. 23. The curve can cause an increase in the distance D2 in a middle part of the face surface f1. Therefore, the rebound performance of the middle part of the face surface f1 can be improved.

Thirteenth and Fourteenth Embodiments: Irons

Figure 24:
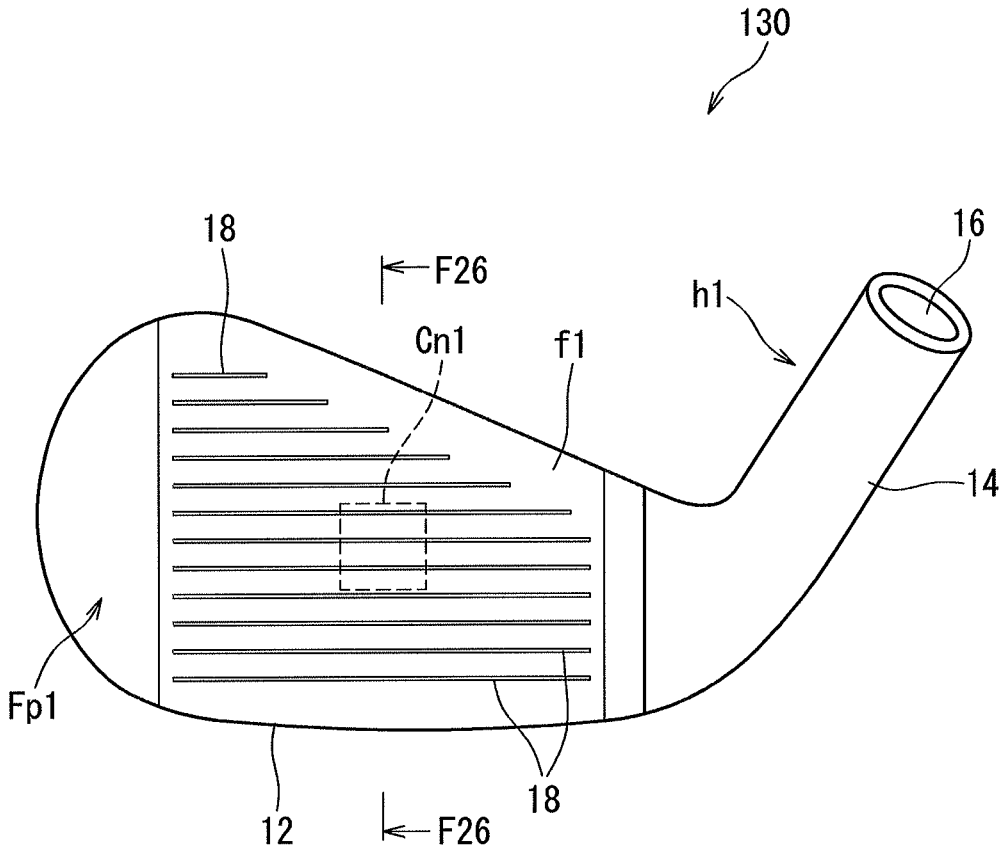
FIG. 24 is a front view of a head according to a thirteenth embodiment.
Figure 25:
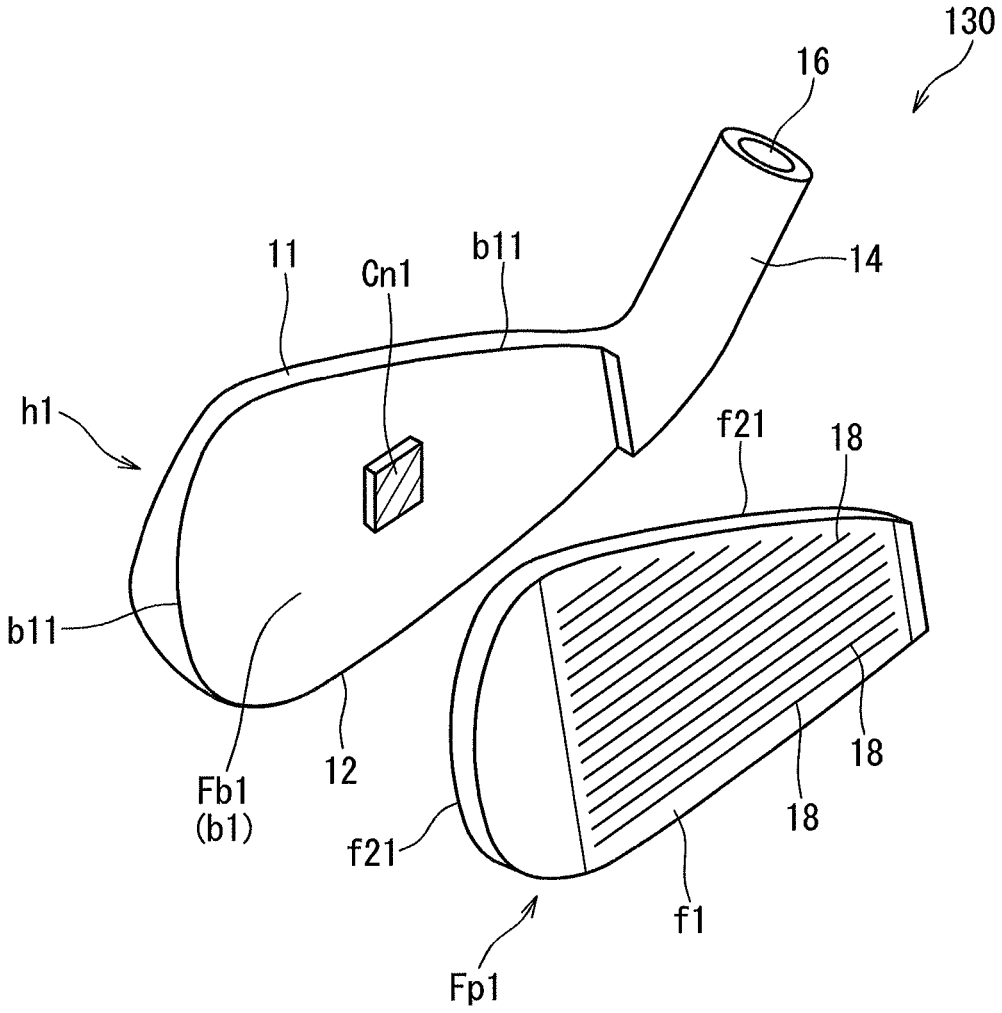
FIG. 25 is an exploded perspective view of the head of FIG. 24.
Figure 26:
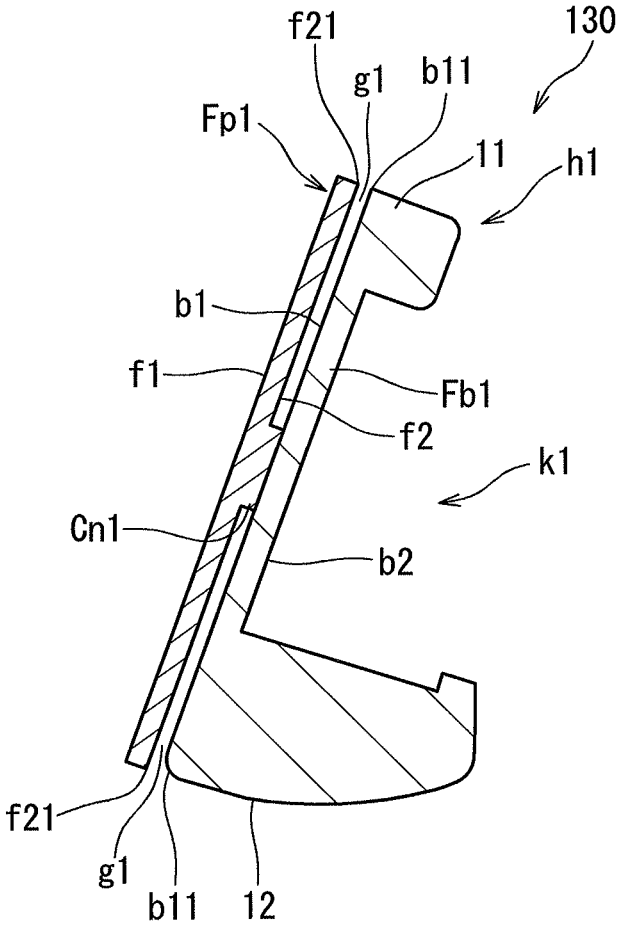
FIG. 26 is a cross-sectional view taken along line F26-F26 of FIG. 24.

FIG. 24 is a front view of a head 130 according to a thirteenth embodiment. The head 130 is an iron head. FIG. 25 is an exploded perspective view of the head 130. FIG. 26 is a cross-sectional view taken along line F26-F26 of FIG. 24.

The head 130 includes a head body h1, a face part Fp1, and a connecting part Cn1. The connecting part Cn1 connects the head body h1 and the face part Fp1 to each other. The face part Fp1 is connected to the head body h1 by only the connecting part Cn1.

The head body h1 includes a top part 11, a sole 12, and a hosel 14. The hosel 14 includes a hosel hole 16.

The head 130 is a so-called cavity back iron. As shown in FIG. 26, the head body h1 includes a cavity part k1. The cavity part k1 is a recess part. The cavity part k1 in the present embodiment is a cavity part of the cavity back iron.

The head body h1 includes a front part Fb1 (see FIGS. 25 and 26). The front part Fb1 is disposed in front of the cavity part k1. The front part Fb1 shields at least a part of a front of the cavity part k1. The front part Fb1 connects an upper part of the head body h1, and a lower part of the head body h1 to each other. In the present embodiment, the upper part of the head body h1 is the top part 11. In the embodiment, the lower part of the head body h1 is the sole 12. As shown in FIG. 25, in the head 130, the front part Fb1 covers the whole front of the cavity part k1. The front part Fb1 is located behind the face part Fp1. The front part Fb1 forms a bottom surface of the cavity part.

The connecting part Cn1 is integrally molded with the face part Fp1. The connecting part Cn1 is joined to the head body h1 (front part Fb1). The joining is welding.

The front part Fb1 includes a front surface b1 and a back surface b2. The front surface b1 is a plane. The back surface b2 is a plane. The back surface b2 faces the cavity part k1. The back surface b2 forms the bottom surface of the cavity part. The connecting part Cn1 connects the front surface b1 and the face part Fp1 to each other.

The face part Fp1 includes a face surface f1 and a face back surface f2. The face surface f1 is a hitting surface. The face back surface f2 is opposed to the front surface b1. A plurality of score line grooves 18 are formed in the face surface f1. Except for the score line grooves 18, the face surface f1 is a plane. The face back surface f2 is a plane. The score line grooves 18 are abbreviated in the cross-sectional view of FIG. 26.

The face part Fp1 is plate-like as a whole. A clearance g1 is provided between the face part Fp1 and the front part Fb1 (see FIG. 26).

The connecting part Cn1 connects the head body h1 and the face part Fp1 to each other. The head body h1 and the face part Fp1 are connected to each other by only the connecting part Cn1. The connecting part Cn1 connects the face back surface f2 and the front surface b1 to each other. Except for a portion at which the connecting part Cn1 is present, the clearance g1 is present between the face back surface f2 and the front surface b1.

As shown in FIG. 26, the connecting part Cn1 is solid. The connecting part Cn1 may be hollow.

As described above, the face part Fp1 includes the face surface f1 and the face back surface f2. The face back surface f2 includes a peripheral edge f21. The connecting part Cn1 is provided at a position separated from the peripheral edge f21.

As shown in FIG. 24, the shape of the connecting part Cn1 in the planar view is a rectangle. In more detail, the shape of the connecting part Cn1 in the planar view is a square.

In the head 130, the whole peripheral edge f21 is separated from the connecting part Cn1. A part of the peripheral edge f21 may be separated from the connecting part Cn1. In other words, the connecting part Cn1 may be connected to a part of the peripheral edge f21.

The connecting part Cn1 is located on a face center Fc side with respect to the peripheral edge f21. In the planar view, the center of gravity of the connecting part Cn1 is located in a face middle region R1. In the planar view, the whole connecting part Cn1 is included in the face middle region R1. A backup region B1 (described below) includes a face center Fc.

As described above, the front part Fb1 of the head body h1 includes the front surface b1. The front surface b1 includes a peripheral edge b11.

In the head 130, the peripheral edge b11 is separated from the connecting part Cn1. The whole peripheral edge b11 is separated from the connecting part Cn1. A part of the peripheral edge b11 may be separated from the connecting part Cn1. In other words, the connecting part Cn1 may be disposed on a part of the peripheral edge b11.

The peripheral edge f21 is separated from the head body h1. The whole peripheral edge f21 is separated from the head body h1. The peripheral edge f21 is separated from the front part Fb1. The clearance g1 is present between the peripheral edge f21 and the head body h1. In the whole peripheral edge f21, the clearance g1 is present between the peripheral edge f21 and the head body h1. The peripheral edge f21 is easily displaced. The clearance g1 easily causes the deformation of the face surface f1 in hitting. A peripheral edge part of the face part Fp1 has a high degree of freedom of deformation. The deformation of the face part Fp1 increases rebound performance. In the head 130, a peripheral edge part of the face surface f1 has excellent rebound performance.

In the head 130, the connecting part Cn1 is provided only in the face middle region R1. The connecting part Cn1 is not present in a face peripheral region R2. The whole face peripheral region R2 is not backed up. The face peripheral region R2 does not include the backup region B1. The whole face peripheral region R2 is a nonbackup region N1. The whole backup region B1 is included in the face middle region R1. In the whole face peripheral region R2, the clearance g1 is present on the back side of the face part Fp1. The face peripheral region R2 has high deformability. The face peripheral region R2 has high rebound performance. The backup region B1 and the nonbackup region N1 will be described below in detail.

Figure 27:
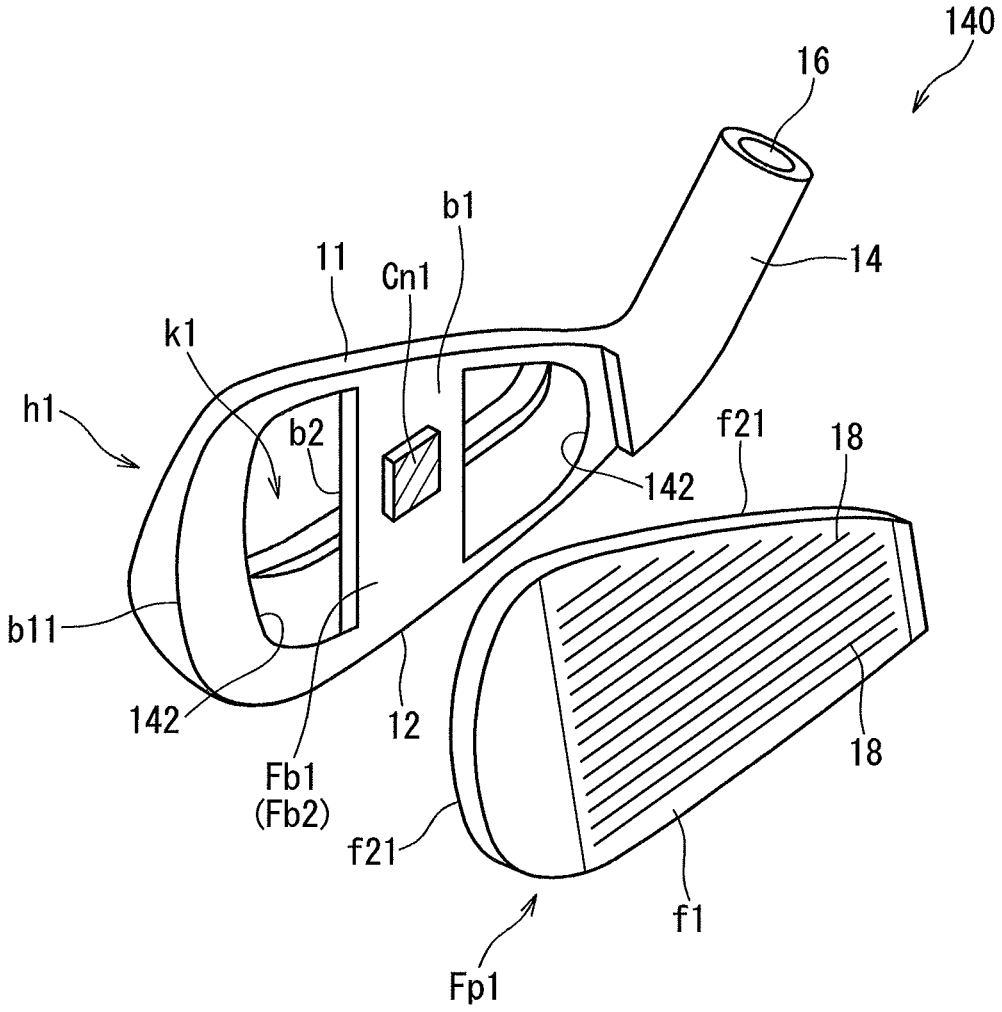
FIG. 27 is an exploded perspective view of a head according to a fourteenth embodiment.

FIG. 27 is an exploded perspective view of a head 140 according to a fourteenth embodiment.

The head 140 includes a head body h1, a face part Fp1, and a connecting part Cn1. The connecting part Cn1 connects the head body h1 and the face part Fp1 to each other. The face part Fp1 is connected to the head body h1 by only the connecting part Cn1.

The head body h1 includes a sole 12 and a hosel 14. The hosel 14 includes a hosel hole 16.

The head 140 is a so-called cavity back iron. The head body h1 includes a cavity part k1 on a back side. The cavity part k1 is a recess part. The cavity part k1 in the present embodiment is a cavity part of the cavity back iron.

The head body h1 includes a front part Fb1. The front part Fb1 is located in front of the cavity part k1. The front part Fb1 shields a part of a front of the cavity part k1.

The connecting part Cn1 is integrally molded with the face part Fp1. The connecting part Cn1 is joined to the head body h1 (front part Fb1). The joining is welding.

The front part Fb1 includes a front surface b1 and a back surface b2. The front surface b1 is a plane. The back surface b2 is a plane. The back surface b2 faces the cavity part k1. The back surface b2 forms a bottom surface of the cavity part. The connecting part Cn1 connects the front surface b1 and the face part Fp1 to each other.

The face part Fp1 includes a face surface f1 and a face back surface. The face surface f1 is a hitting surface. The face back surface is opposed to the front surface b1. A plurality of score line grooves 18 are formed in the face surface f1. Except for the score line grooves 18, the face surface f1 is a plane. The face back surface is a plane.

The face part Fp1 is plate-like as a whole. A clearance is provided between the face part Fp1 and the front part Fb1.

The connecting part Cn1 connects the head body h1 and the face part Fp1 to each other. The head body h1 and the face part Fp1 are connected to each other by only the connecting part Cn1. The connecting part Cn1 connects the face back surface and the front surface b1 to each other. Except for a portion at which the connecting part Cn1 is present, a clearance is present between the face back surface f2 and the front surface b1.

The face back surface includes a peripheral edge f21. The connecting part Cn1 is provided at a position separated from the peripheral edge f21. In the head 140, the whole peripheral edge f21 is separated from the connecting part Cn1. A part of the peripheral edge f21 may be separated from the connecting part Cn1. In other words, the connecting part Cn1 may be connected to a part of the peripheral edge f21.

The connecting part Cn1 is located on a face center Fc side with respect to the peripheral edge f21. In the planar view, the center of gravity of the connecting part Cn1 is located in a face middle region R1. In the planar view, the whole connecting part Cn1 is included in the face middle region R1. A backup region B1 (described below) includes a face center Fc.

The front part Fb1 of the head body h1 includes the front surface b1. The front surface b1 has a peripheral edge b11.

The peripheral edge b11 is separated from the connecting part Cn1. The whole peripheral edge b11 is separated from the connecting part Cn1. A part of the peripheral edge b11 may be separated from the connecting part Cn1. In other words, the connecting part Cn1 may be disposed on a part of the peripheral edge b11.

The peripheral edge f21 is separated from the head body h1. The whole peripheral edge f21 is separated from the head body h1. The peripheral edge f21 is separated from the front part Fb1. A clearance is present between the peripheral edge f21 and the head body h1. In the whole peripheral edge f21, the clearance is present between the peripheral edge f21 and the head body h1. The clearance easily causes the displacement of the peripheral edge f21. A face surface f1 is easily deformed in hitting. A peripheral edge part of the face part Fp1 has a high degree of freedom of deformation. The deformation of the face part Fp1 increases rebound performance. In the head 140, a peripheral edge part of the face surface f1 has excellent rebound performance.

The connecting part Cn1 of the head 140 is the same as the connecting part Cn1 of the above-mentioned head 130. The difference between the head 140 and the head 130 exists in the front part Fb1. In the head 130, the front part Fb1 blocks the whole front of the cavity part k1 of the head body h1. Meanwhile, in the head 140, the front part Fb1 shields a part of a front of the cavity part k1 of the head body h1. As shown in FIG. 27, an opening 142 is formed in the head body h1. A portion at which the front part Fb1 is not present forms the opening 142. The opening 142 is formed by the lack of the front part Fb1. In FIG. 27, under the presence of the opening 142, the cavity part of the head body h1 is viewable.

Thus, the front part Fb1 of the head 140 is a partial front part Fb2 blocking a part of the front of the cavity part k1 of the head body h1. The opening 142 is formed so as to be adjacent to the partial front part Fb2. A first opening 142 is formed on the toe side of the partial front part Fb2. A second opening 142 is formed on the heel side of the partial front part Fb2. The partial front part Fb2 is likely to be deformed. In hitting, the amount of deformation of the partial front part Fb2 is large. The partial front part Fb2 contributes to an improvement in rebound performance.

The head 140 includes the first opening 142 provided on the toe side of the front part Fb1 and the second opening 142 provided on the heel side of the front part Fb1. Therefore, the front part Fb1 is easily deformed. Large deformation is generated in a middle part of the front part Fb1. In the head 140, the face middle region R1 has high rebound performance.

Figure 28:
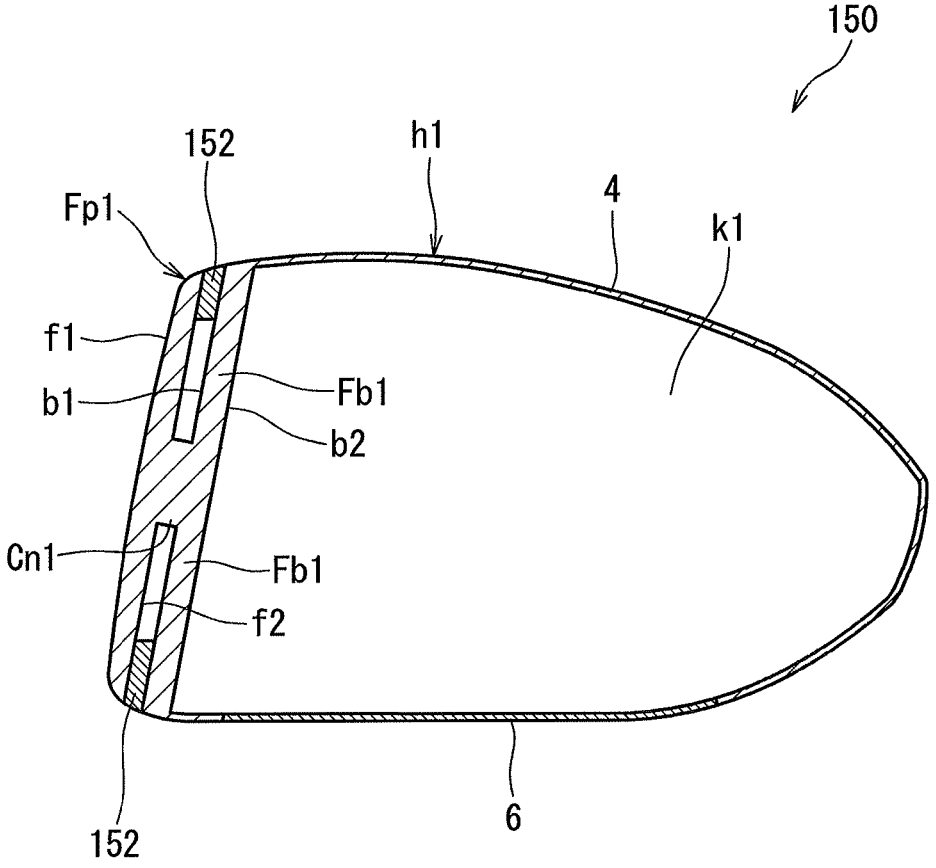
FIG. 28 is a cross-sectional view of a head according to a fifteenth embodiment.

FIG. 28 is a cross-sectional view of a head 150 according to a fifteenth embodiment. The head 150 includes an interposition member 152. The clearance g1 is filled with the interposition member 152. The interposition member 152 is disposed between a face part Fp1 and a front part Fb1. A space located between the face part Fp1 and the front part Fb1 is partially filled with the interposition member 152. The space located between the face part Fp1 and the front part Fb1 may be wholly filled with the interposition member 152. The interposition member 152 can prevent the intrusion of a foreign substance into the clearance g1. The interposition member 152 can increase appearance properties or designability. The head 150 is the same as the above-mentioned head 2 except for presence of the interposition member 152.

In respect of rebound performance, it is preferable that the interposition member 152 does not inhibit the deformation of the face part Fp1. In respect of the rebound performance, the interposition member 152 is preferably flexible. In this respect, the material of the interposition member 152 is preferably a polymer. Examples of the polymer include a rubber and a resin. The resin is preferably a synthetic resin. In respect of the rebound performance, the Young's modulus of the interposition member 152 is preferably equal to or less than 1 GPa, more preferably equal to or less than 500 MPa, and still more preferably equal to or less than 100 MPa. In respect of preventing disengagement, the Young's modulus of the interposition member 152 is preferably equal to or greater than 0.1 MPa.

Thus, in respect of the rebound performance, it is preferable that a space is provided behind a peripheral edge f20 of the face part Fp1, or the interposition member is disposed behind a peripheral edge f20 of the face part Fp1.

Figure 29:
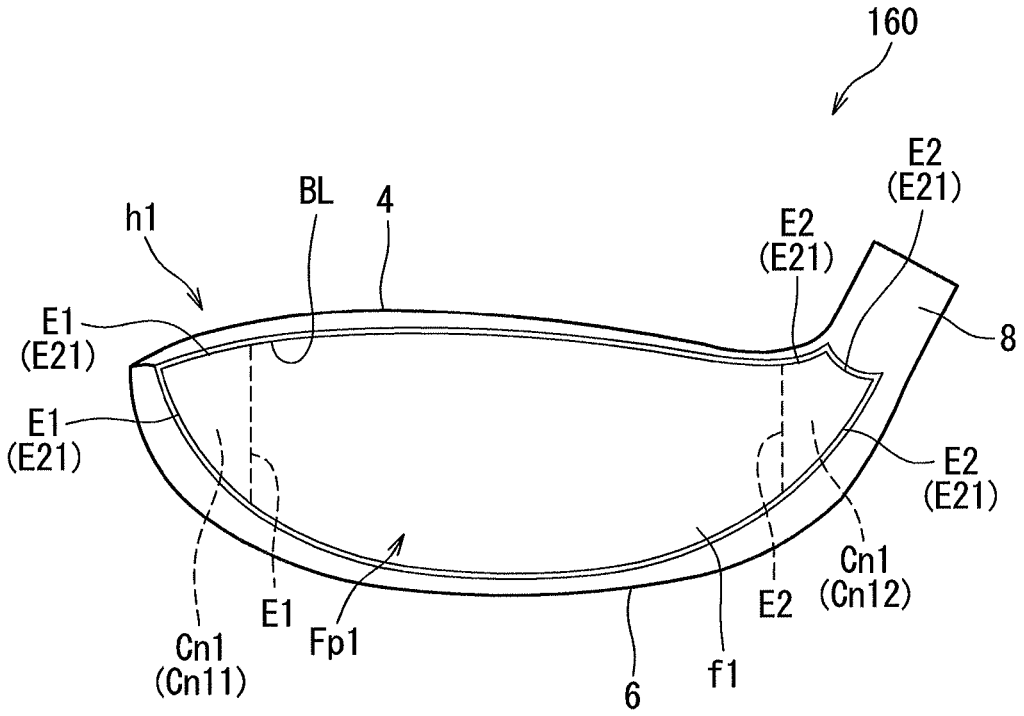
FIG. 29 is a front view of a head according to a sixteenth embodiment.

FIG. 29 is a cross-sectional view of a head 160 according to a sixteenth embodiment. The head 160 is a fairway wood.

The head 160 includes a head body h1, a face part Fp1, and a connecting part Cn1. A plurality of (two) connecting parts Cn1 are provided. The two connecting parts Cn1 connect the head body h1 and the face part Fp1 to each other. The face part Fp1 is connected to the head body h1 by only these connecting parts Cn1. The head body h1 includes a crown 4, a sole 6, and a hosel 8. The hosel 8 includes a hosel hole. The head body h1 includes a cavity part. The head 160 is a hollow head. The head body h1 includes a front part disposed in front of the cavity part.

A first connecting part Cn11 is disposed on a toe region. A second connecting part Cn12 is disposed on a heel region. The plurality of (two) connecting parts Cn1 stably support the face part Fp1.

The difference between the head 160 and the above-mentioned head 120 is only the connecting part Cn1. As compared with the head 120, in the head 160 the first connecting part Cn11 is located on a further toe side, and the second connecting part Cn12 is located on a further heel side.

A clearance between the face part Fp1 and the head body h1 penetrates from the crown 4 to the sole 6 between the connecting part Cn11 and the connecting part Cn12. The clearance between the face part Fp1 and the head body h1 penetrates the head 160 in an up-down direction. The face part Fp1 has a high degree of freedom of deformation between the connecting part Cn11 and the connecting part Cn12.

The first connecting part Cn11 is disposed on the most toe side. For this reason, an outer edge E1 of the connecting part Cn11 includes a common part E21 shared with a peripheral edge f21 of a face back surface f2. The second connecting part Cn12 is disposed on the most heel side. For this reason, an outer edge E2 of the connecting part Cn12 includes the common part E21. In the head 160, a distance in a toe-heel direction between the first connecting part Cn11 and the second connecting part Cn12 is large. For this reason, a face region which is not backed up by the connecting part Cn1 is broadened. The face region is likely to be deformed by hitting, and has excellent rebound performance.

In the head 160, the connecting part Cn1 is not provided at a position separated from the peripheral edge of the face back surface. However, in the head 160, the peripheral edge of the face back surface is separated from the head body h1. That is, in a nonbackup region N1, the peripheral edge of the face back surface is separated from the head body h. Therefore, the rebound performance of a middle part of a face surface f1 in the toe-heel direction is high. In the middle part in the toe-heel direction, all of the upper part, the middle part, and the lower part of the face surface f1 are the nonbackup region N1. Therefore, all of the upper part, the middle part, and the lower part have high rebound performance.

Figure 30:
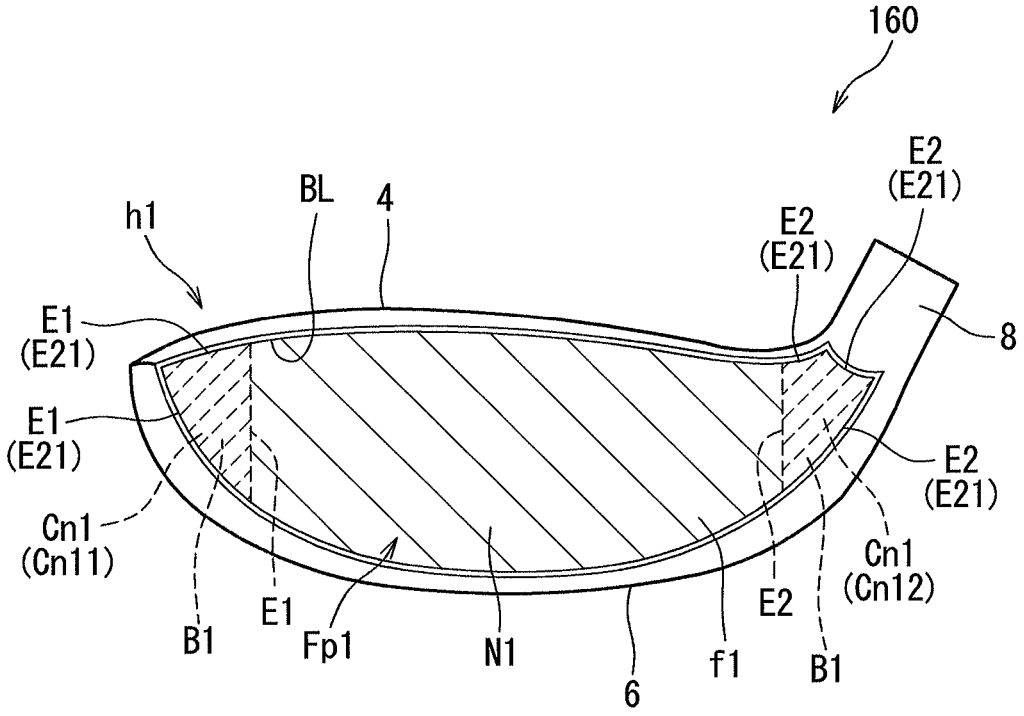
FIG. 30 is a front view showing a backup region and a nonbackup region.

A backup region B1 and a nonbackup region N1 are shown with the head 160 as an example in FIG. 30. A region backed up by the connecting part Cn1 in the face surface f1 is the backup region B1. A region which is not backed up by the connecting part Cn1 in the face surface f1 is the nonbackup region N1. The backup region B1 and the nonbackup region N1 are estimated in the planar view. In FIG. 30, the backup region B1 is shown by dashed line hatching, and the nonbackup region N1 is shown by solid line hatching. In the nonbackup region N1, a space (clearance g1) is present on the back side of the face part Fp1. In the nonbackup region N1, an interposition member 152 may be present on the back side of the face part Fp1 (see FIG. 28).

The area of the backup region B1 is defined as Sb. The area of the nonbackup region N1 is defined as Sn. In the embodiment of FIG. 30, the total of the areas of the two backup regions B1 is Sb. In respect of the rebound performance, a ratio [Sb/Sn] is preferably equal to or less than 0.5, more preferably equal to or less than 0.4, still more preferably equal to or less than 0.3, and yet still more preferably equal to or less than 0.25. In respect of a strength, the ratio [Sb/Sn] is preferably equal to or greater than 0.05, and more preferably equal to or greater than 0.1.

In respect of the rebound performance, a CT value in a face center Fc is preferably equal to or greater than 160 μs, more preferably equal to or greater than 170 μs, still more preferably equal to or greater than 180 μs, and yet still more preferably equal to or greater than 190 μs. In respect of the golf rule, the CT value in the face center Fc is preferably equal to or less than 257 μs.

Usually, the face area of the fairway wood is smaller than the face area of a driver. For this reason, in the fairway wood, the deformation of the face in hitting may not be sufficiently obtained. This point is the same also in a utility type club, a hybrid type club, and an iron type club. By the above-mentioned technique, the rebound performance can be improved also in a head having a small face area. In this respect, a head volume is preferably equal to or less than 300 cc, more preferably less than 300 cc, still more preferably equal to or less than 280 cc, and yet still more preferably equal to or less than 260 cc. In the wood type club, the utility type club, and the hybrid type club (including a hollow iron), the rebound performance and the flight distance are considered to be particularly important. If the point is also considered, the head volume is preferably equal to or greater than 100 cc.

In respect of the rebound performance, the thickness of the face part Fp1 is preferably equal to or less than 5 mm, and more preferably equal to or less than 4 mm. In respect of the strength, the thickness of the face part Fp1 is preferably equal to or greater than 1.0 mm, more preferably equal to or greater than 1.5 mm, still more preferably equal to or greater than 1.8 mm, and yet still more preferably equal to or greater than 2 mm. The thickness of the face part Fp1 may be uniform or non-uniform. In Examples to be described below, the thickness of the face part Fp1 is non-uniform. In Examples, the thickness of the face part Fp1 near the middle of the face part Fp1 is 4 mm, and the thickness of the face part Fp1 in the peripheral edge is 2 mm.

A distance between the face back surface f2 and the front surface b1 is shown by a double-headed arrow v1 in FIG. 4. In respect of allowing the deformation of the face part Fp1, the distance v1 is preferably equal to or greater than 0.2 mm, more preferably equal to or greater than 0.5 mm, and still more preferably equal to or greater than 1.0 mm. In respect of good appearance, and in respect of suppressing the intrusion of a foreign substance, the distance v1 is preferably equal to or less than 20 mm, more preferably equal to or less than 10 mm, and still more preferably equal to or less than 8 mm. The distance v1 is measured along a face-back direction. The distance v1 may be uniform or non-uniform.

The material of the head body h1 is not limited. Examples of the material of the head body h1 include a metal and CFRP (carbon fiber reinforced plastic). Examples of the metal include one or more kinds selected from soft iron, pure titanium, a titanium alloy, stainless steel, maraging steel, an aluminium alloy, a magnesium alloy, and a tungsten-nickel alloy. Examples of the stainless steel include SUS630 and SUS304. Specific examples of the titanium alloy include 6-4 titanium (Ti-6Al-4V), Ti-15V-3Cr-3Sn-3Al, and Ti-6-22-22S. The soft iron means low carbon steel having a carbon content of less than 0.3 wt %. The material of the head body h1 can be preferably welded to the connecting part Cn1. The material of the head body h1 may be the same as the material of the connecting part Cn1.

The material of the face part Fp1 is not limited. Examples of the material of the face part Fp1 include a metal and CFRP (carbon fiber reinforced plastic) or the like. Examples of the metal include one or more kinds selected from soft iron, pure titanium, a titanium alloy, stainless steel, maraging steel, an aluminium alloy, a magnesium alloy, and a tungsten-nickel alloy. Examples of the stainless steel include SUS630 and SUS304. Specific examples of the titanium alloy include 6-4 titanium (Ti-6Al-4V), Ti-15V-3Cr-3Sn-3Al, and Ti-6-22-22S or the like. The material of the face part Fp1 can be preferably welded to the connecting part Cn1. The material of the face part Fp1 may be the same as the material of the connecting part Cn1.

The face part Fp1 may be made of a rolled material. The rolled material has few defects, and has an excellent strength. The face part Fp1 may be made of a forging material. The forging material has few defects, and has an excellent strength. The face part Fp1 having an excellent strength can exhibit high durability while allowing large deformation.

As described above, the face surface f1 is a three-dimensional curved surface having the bulge and the roll. In respect of applying the bulge and the roll, the face part Fp1 may be formed by bending work.

A preferable example of the head is a driver head. The driver means a number 1 wood (W #1). High flight distance performance is required for the driver. Therefore, the present invention is preferably applied. Usually, the driver head has the following constitution.

(1a) curved face surface (1b) cavity part (1c) volume of 300 cc or greater and 460 cc or less (1d) real loft of 7 degrees or greater and 14 degrees or less Another preferable example of the head is a fairway wood head. Examples of the fairway wood include a number 3 wood (W #3), a number 4 wood (W #4), a number 5 wood (W #5), a number 7 wood (W #7), a number 9 wood (W #9), a number 11 wood (W #11), and a number 13 wood (W #13). Usually, the fairway wood head has the following constitution.

(2a) curved face surface (2b) cavity part (2c) volume of 100 cc or greater and less than 300 cc (2d) real loft of greater than 14 degrees and 33 degrees or less More preferably, the volume of the fairway wood head is 100 cc or greater and 200 cc or less.

The head of the fairway wood is smaller than the head of the driver. A smaller head includes a face surface having a smaller area. The conventional structure makes it difficult to increase the rebound performance of the smaller face surface. The above-mentioned structure is effective for increasing the rebound performance of the smaller face surface.

A ball placed on a ground (lawn) is often hit by the fairway wood. In other words, a ball which is not teed up is often hit by the fairway wood. Therefore, in the fairway wood, a hit point tends to be located on the lower side of the face surface. In the conventional structure, the deflection of a lower edge part of a face surface is small. The conventional structure makes it difficult to increase the rebound performance of the lower edge part of the face surface. The above-mentioned structure can solve the problem.

Still another preferable example of the head is a utility type head (hybrid type head). Usually, the utility type head (hybrid type head) has the following constitution.

(3a) curved face surface (3b) cavity part (3c) volume of 100 cc or greater and 200 cc or less (3d) real loft of 15 degrees or greater and 33 degrees or less More preferably, the volume of the utility type head (hybrid type head) is 100 cc or greater and 150 cc or less.

The head of the utility type club (hybrid type club) is smaller than the head of the driver. In the conventional structure, the amount of deflection of the smaller face surface is smaller. The above-mentioned structure is effective for increasing the rebound performance of the smaller face surface.

A ball placed on a ground (lawn) is often hit by the utility club (hybrid club). In other words, a ball which is not teed up is often hit by the utility club (hybrid club). Therefore, in the utility club (hybrid club), a hit point tends to be located on the lower side of the face surface. In the conventional structure, the deflection of a lower edge part of a face surface is smaller. The conventional structure makes it difficult to increase the rebound performance of the lower edge part of the face surface. In the above-mentioned head, the deflection of the lower edge part of the face surface is large. The above-mentioned structure can increase the rebound performance of the lower edge part of the face surface.

EXAMPLES

Hereinafter, the effects of the present invention will be clarified by Examples. However, the present invention should not be interpreted in a limited way based on the description of Examples.

Comparative Example

A number 3 wood of XXIO PRIME manufactured by Dunlop Sports Co., Ltd. (launched on 2013) was used as a reference head. Three-dimensional data of the reference head was subjected to element breakdown to obtain head data of Comparative Example. The physical properties of each portion of the head were set so as to close as possible to an actual head. The specifications of Comparative Example are shown in the following Table 1.

Example 1

A face part of the head data of Comparative Example was removed to form an opening, and a plate-like front part was provided so as to block the opening. Furthermore, a connecting part Cn1 and a face part Fp1 were provided on a front surface b1 of the front part, to obtain head data of Example 1. The structure of Example 1 is the same as the structure of the above-mentioned head 60.

Figure 31:
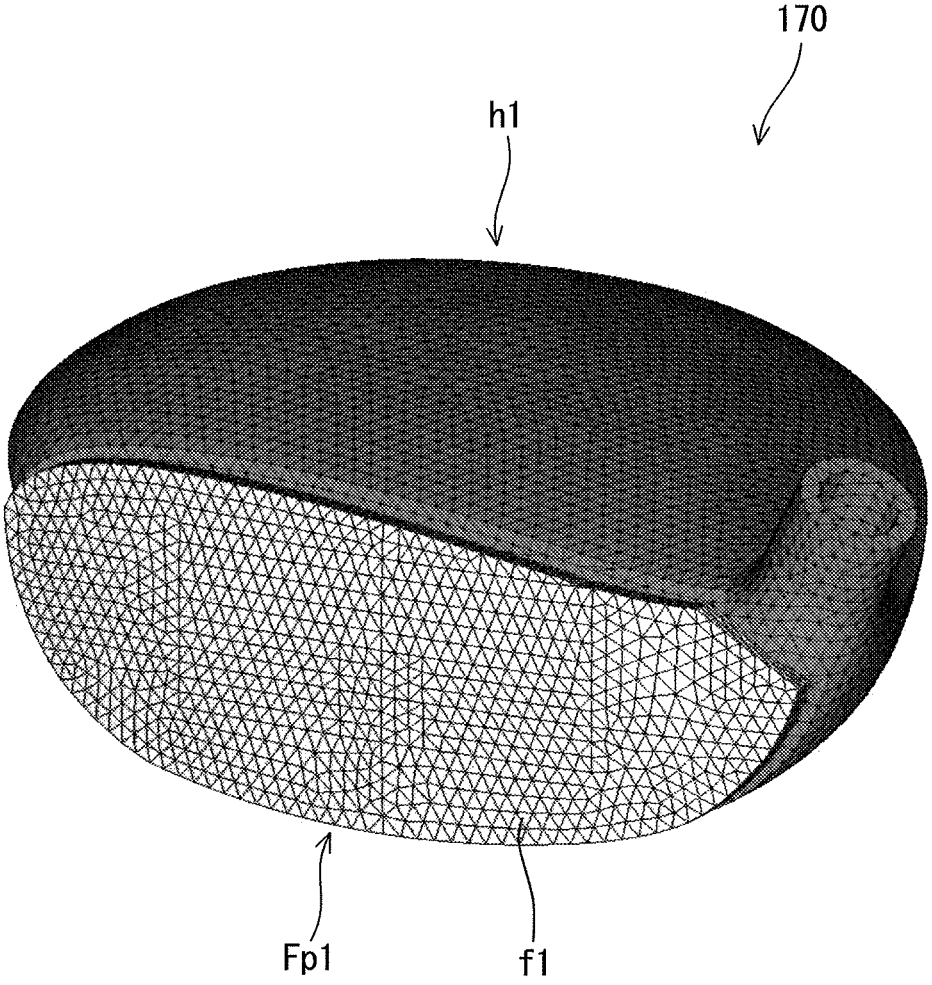
FIG. 31 shows an image of an FE model showing a perspective view of a head according to Example 1.
Figure 32:
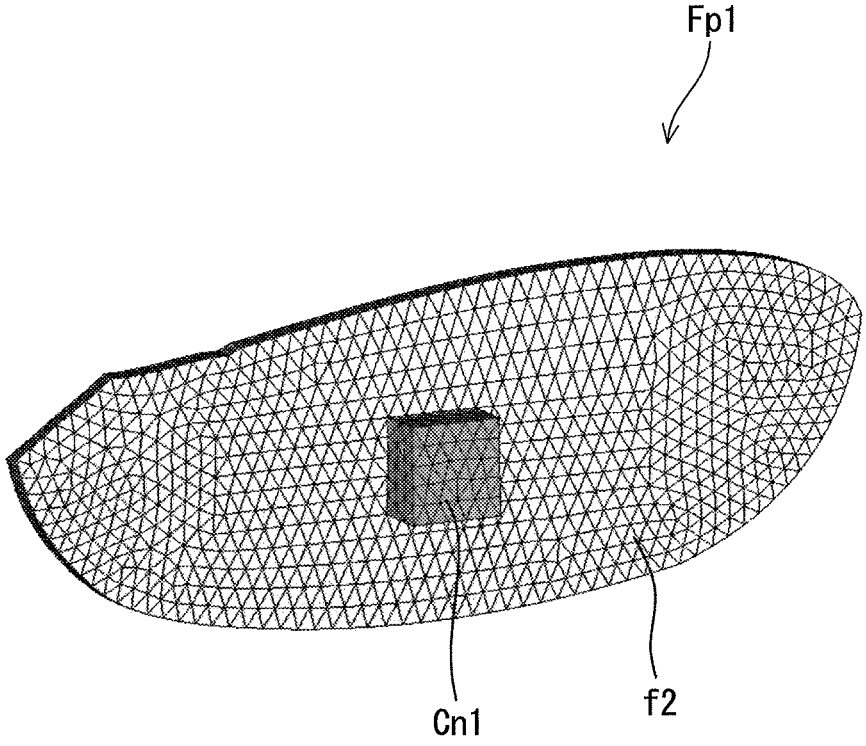
FIG. 32 shows an image of an FE model showing a face part and a connecting part of Example 1.
Figure 33:
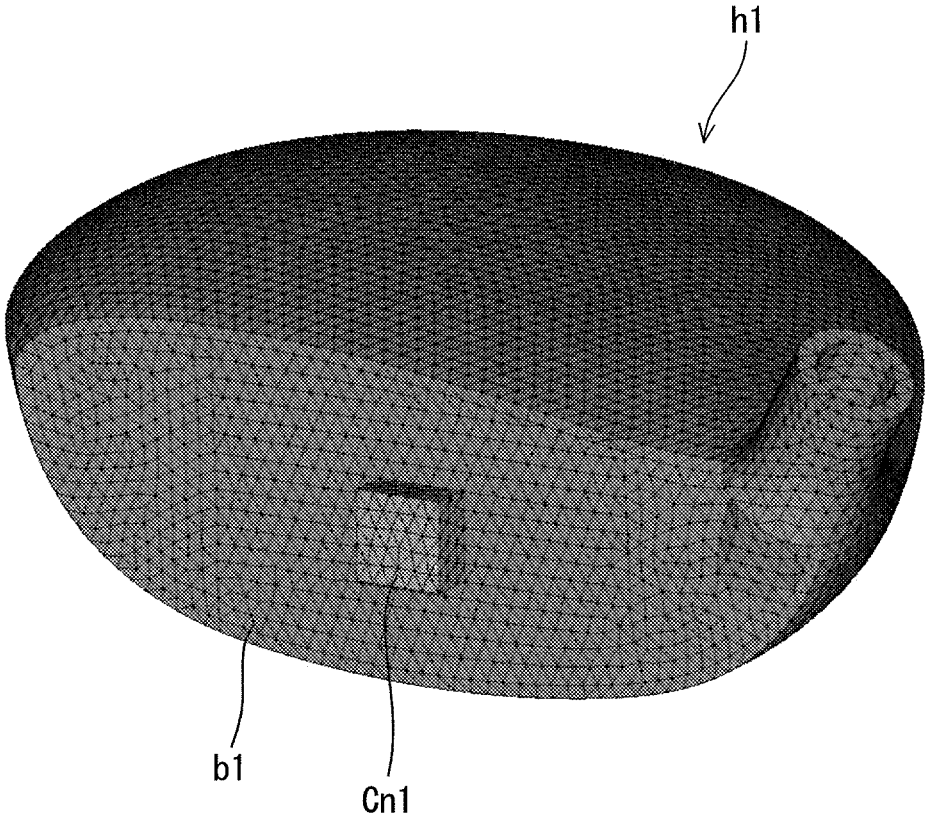
FIG. 33 shows an image of an FE model showing a head body and a connecting part of Example 1.
Figure 34:
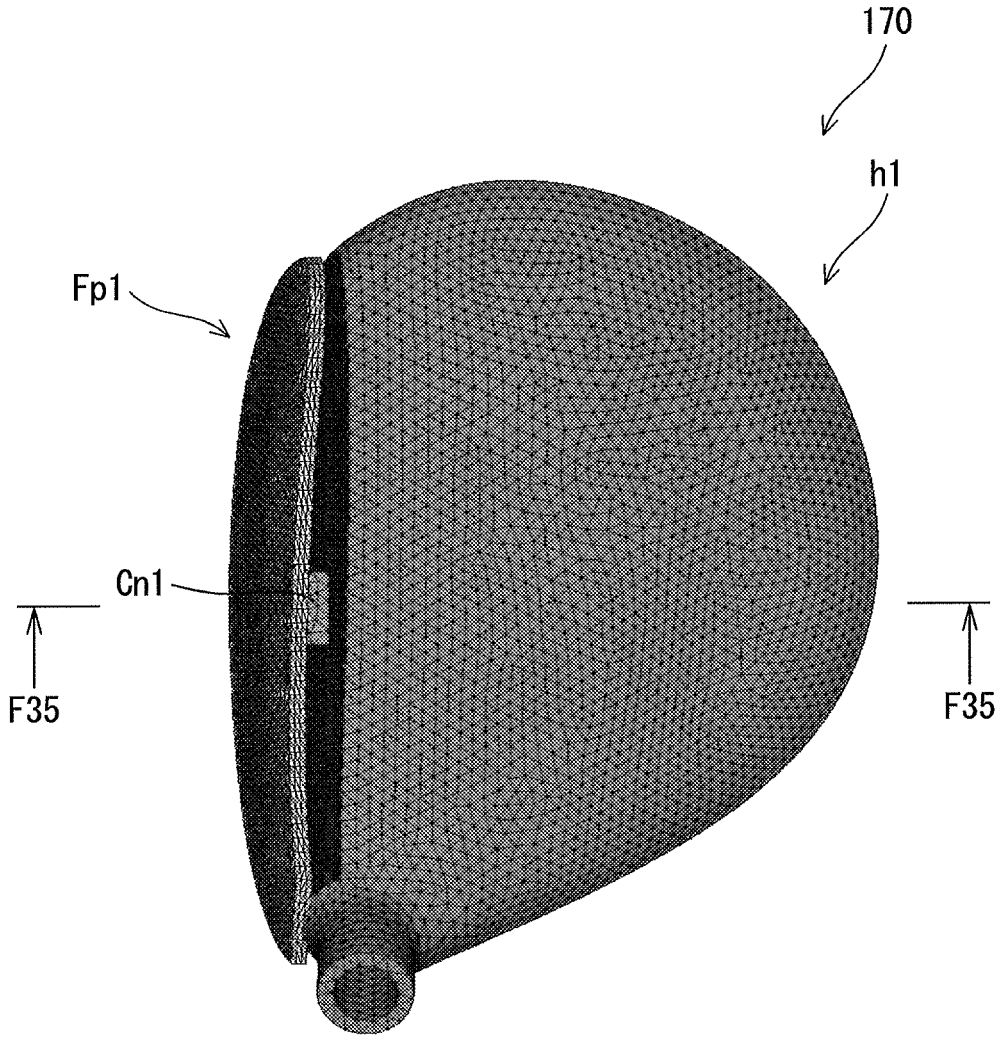
FIG. 34 shows an image of an FE model showing a top view of a head according to Example 1.
Figure 35:
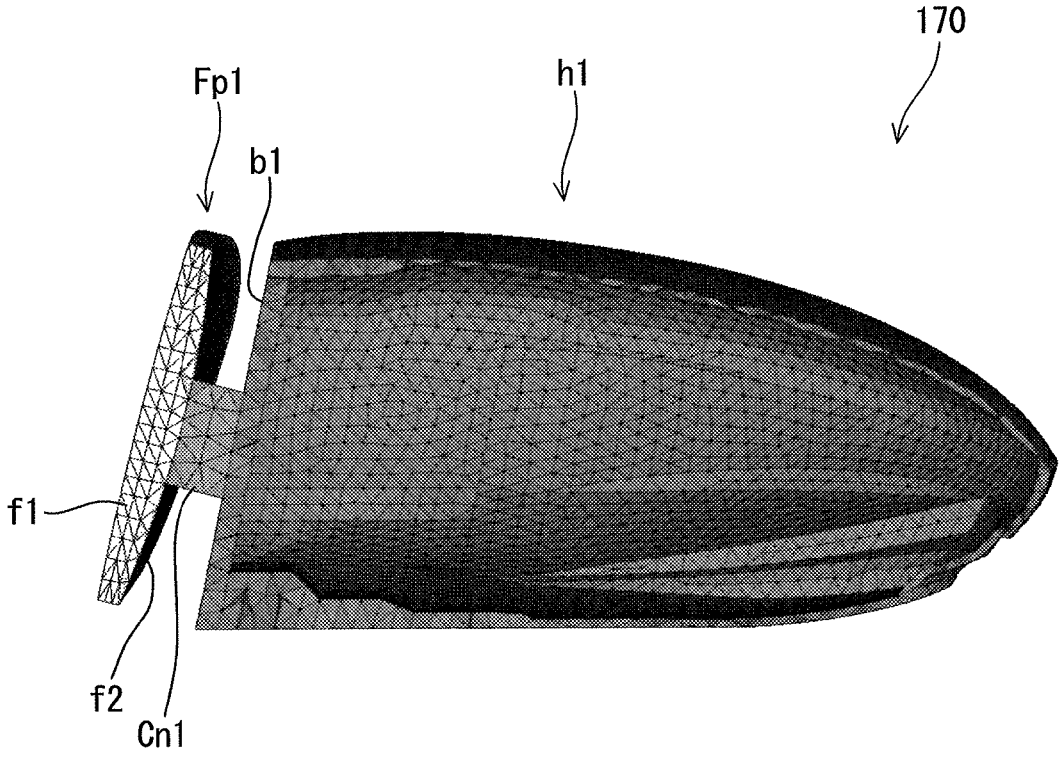
FIG. 35 shows an image of an FE model showing a cross-sectional view taken along line F35-F35 of FIG. 34.

FIGS. 31 to 35 show an image of an FE model (finite element model) of a head 170 according to Example 1. FIG. 31 is a perspective view of the head 170. FIG. 32 is a perspective view of a face part Fp1 of the head 170 viewed from a back side. FIG. 33 is a perspective view of a head body h1 of the head 170. FIG. 34 is a top view of the head 170. FIG. 35 is a cross-sectional view taken along line F35-F35 of FIG. 34. Hatching showing a section is abbreviated in the cross-sectional view.

As a result of performing simulation for making a ball collide with Example 1, the displacement of a peripheral edge part of the face part Fp1 was confirmed to be greater than the displacement of Comparative Example.

Example 2

Head data of Example 2 was obtained in the same manner as in Example 1 except that a toe part and a heel part of a front part were removed, and a connecting part Cn1 had a rectangle shape which was longer in a toe-heel direction. The structure of Example 2 is the same as the structure of the above-mentioned head 50.

Figure 36:
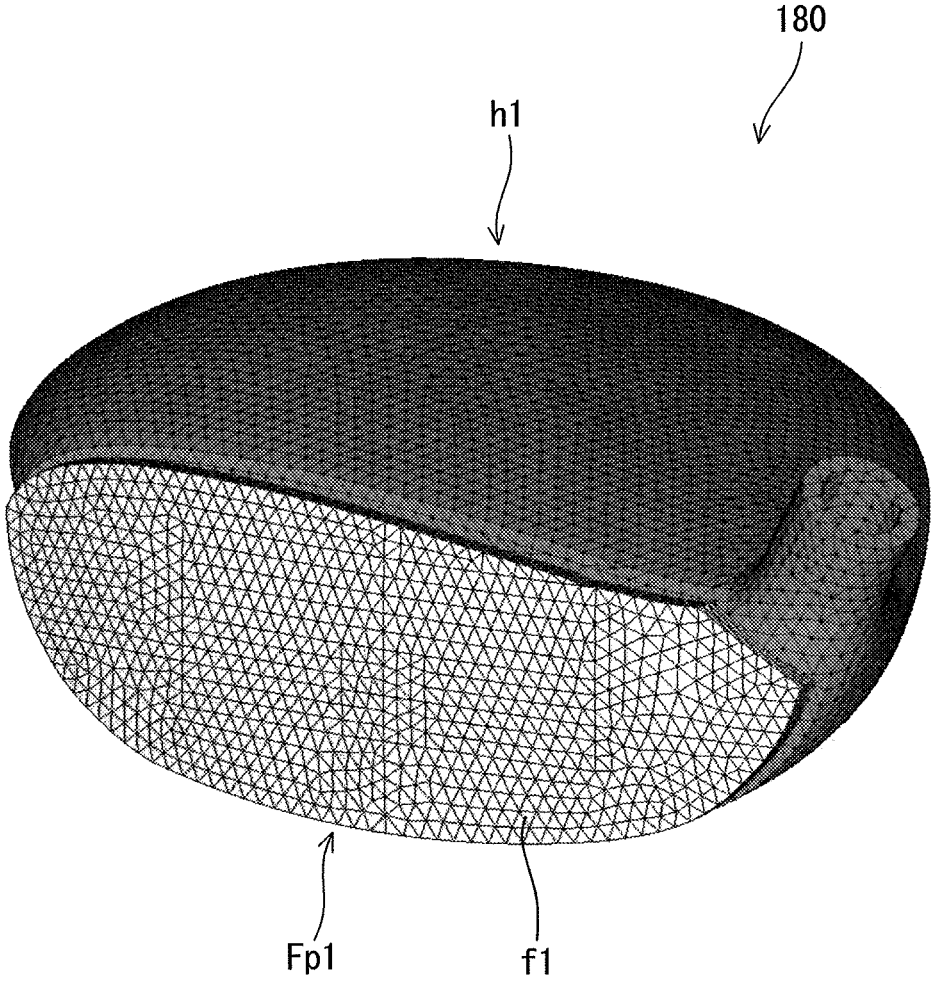
FIG. 36 shows an image of an FE model showing a perspective view of a head according to Example 2.
Figure 37:
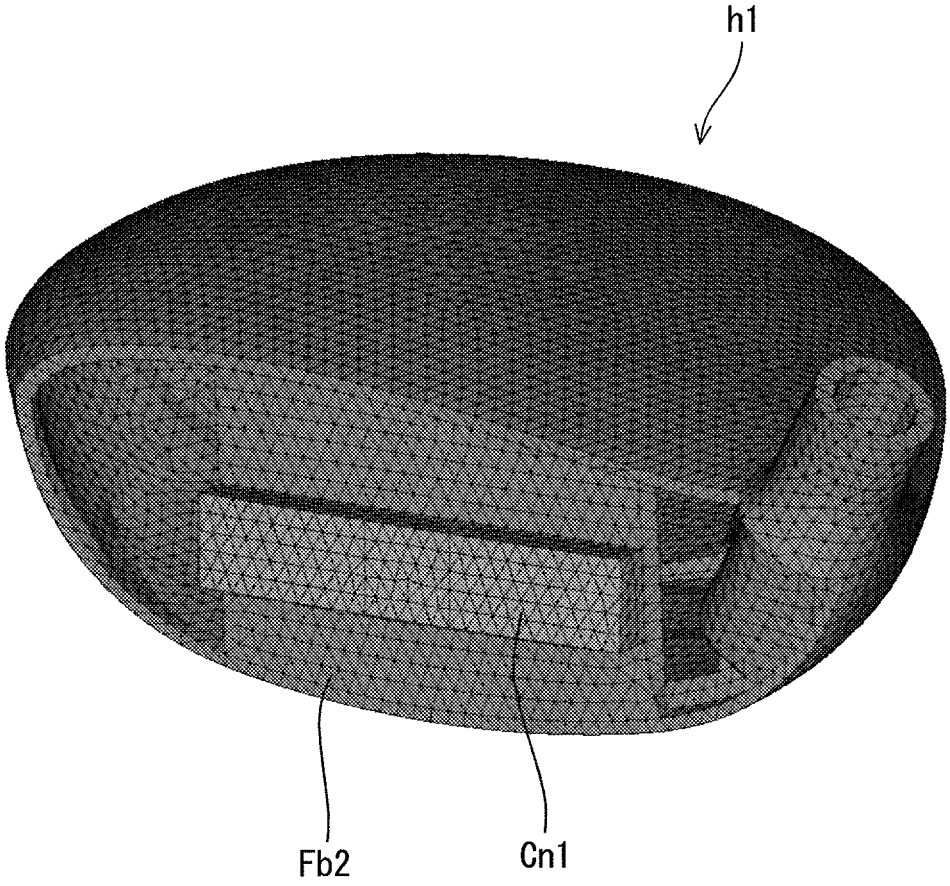
FIG. 37 shows an image of an FE model showing a head body and a connecting part of Example 2.

FIGS. 36 and 37 show an image of an FE model of a head 180 according to Example 2. FIG. 36 is a perspective view of the head 180. FIG. 37 is a perspective view of a head body h1 of the head 180. As a result of performing simulation for making a ball collide with Example 2, an upper edge part and a lower edge part of a face part Fp1 were confirmed to be displaced more largely than the upper edge part and the lower edge part of the face part Fp1 of Example 1. The large displacement was caused by the deformation of a front part Fb1 (partial front part Fb2).

Example 3

Head data of Example 3 was obtained in the same manner as in Example 1 except that a connecting part Cn1 had a rectangle shape which was longer in a toe-heel direction, and was moved to an upper side. The structure of Example 3 is the same as the structure of the above-mentioned head 70.

Figure 38:
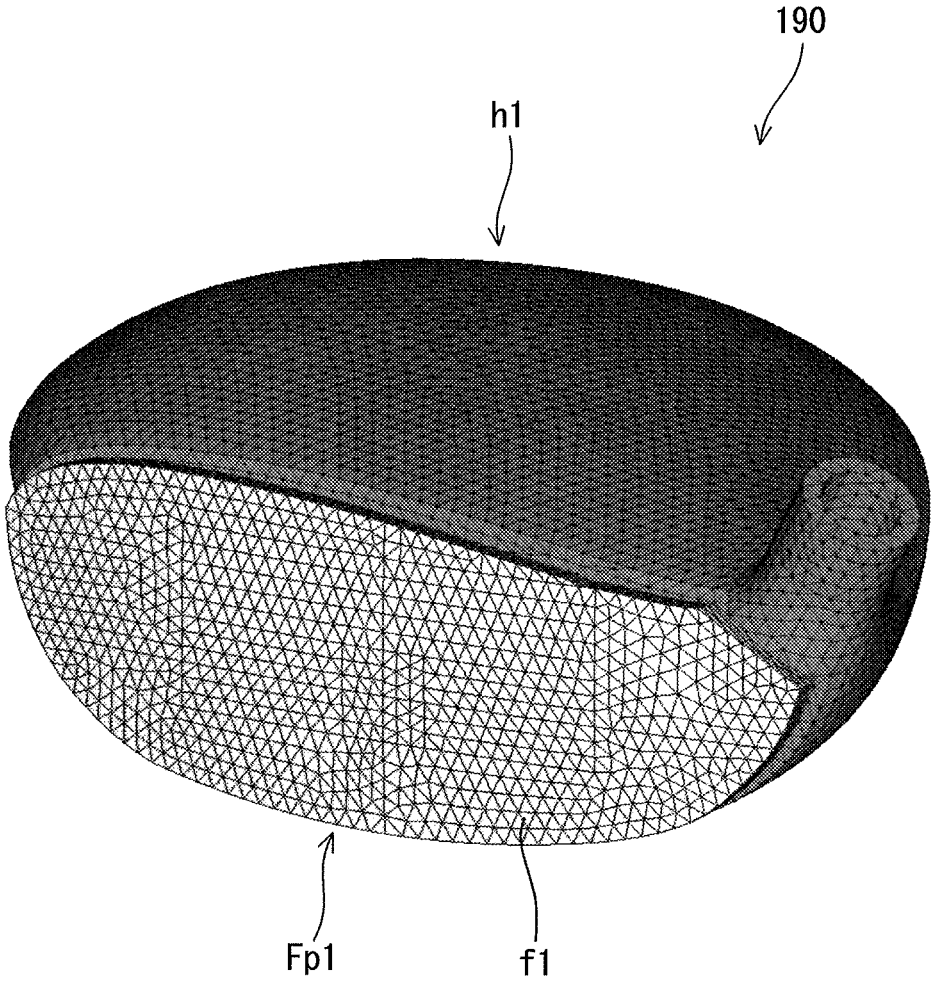
FIG. 38 shows an image of an FE model showing a perspective view of a head according to Example 3.
Figure 39:
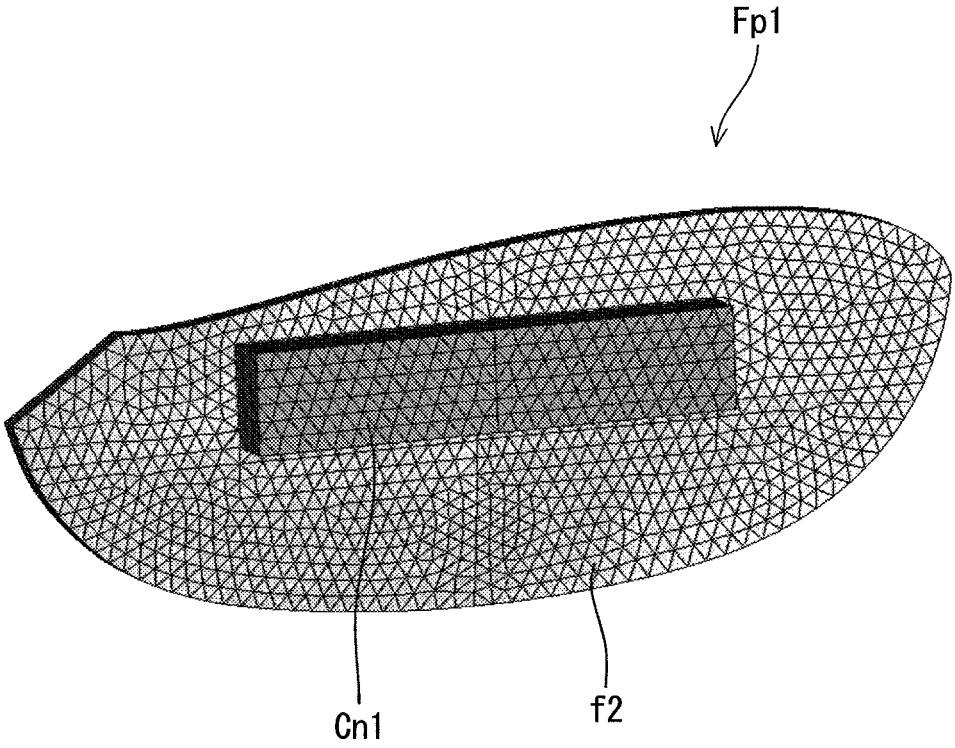
FIG. 39 shows an image of an FE model showing a face part and a connecting part of Example 3.
Figure 40:
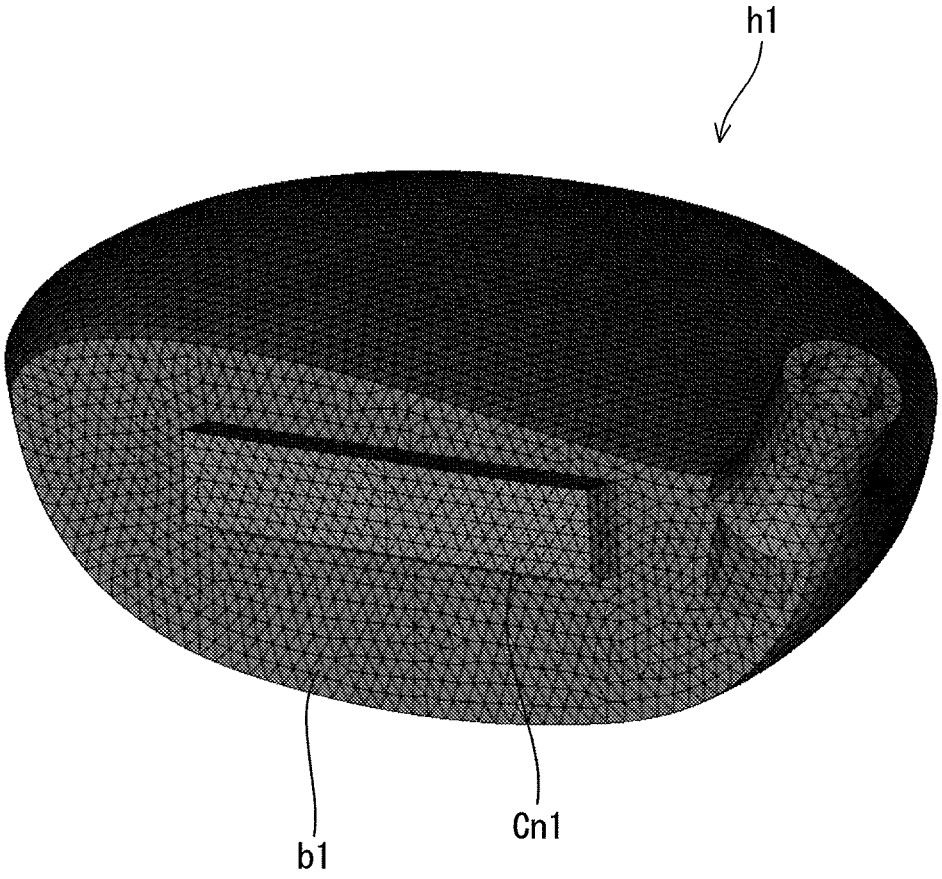
FIG. 40 shows an image of an FE model showing a head body and a connecting part of Example 3.
Figure 41:
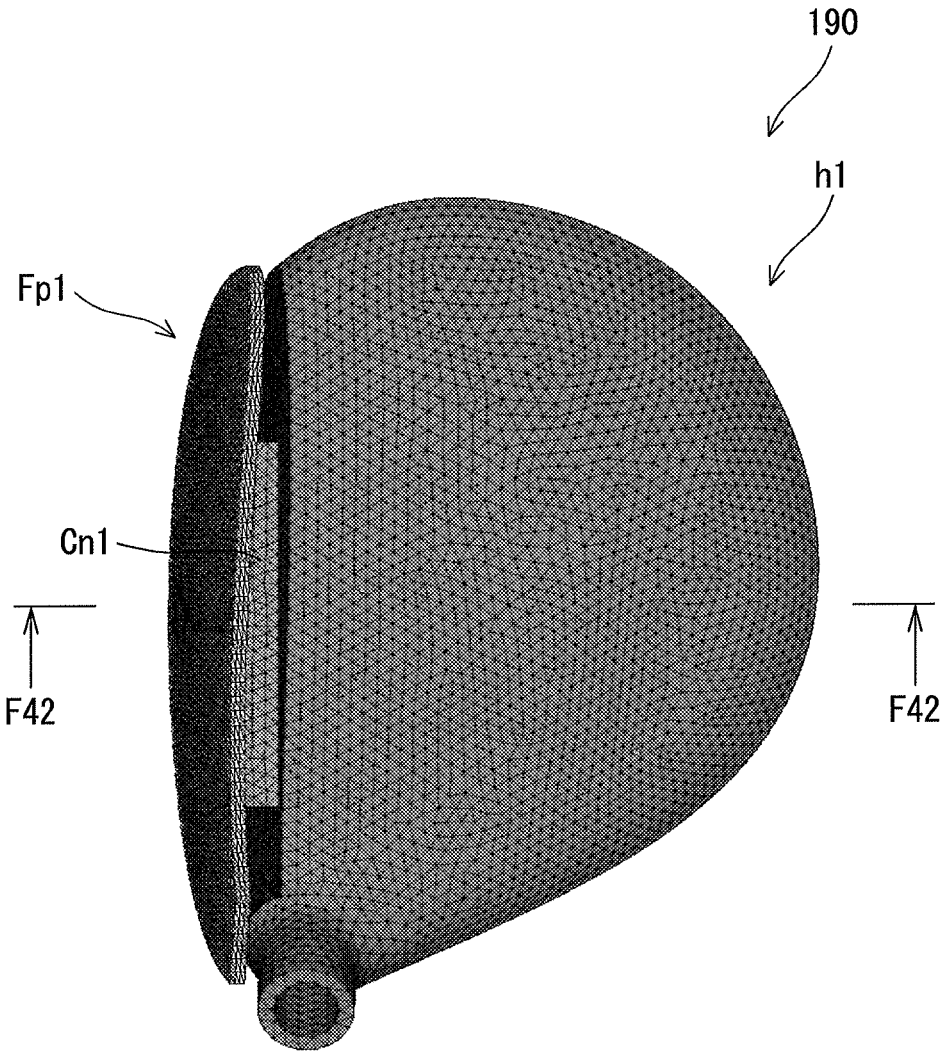
FIG. 41 shows an image of an FE model showing a top view of a head according to Example 3.
Figure 42:
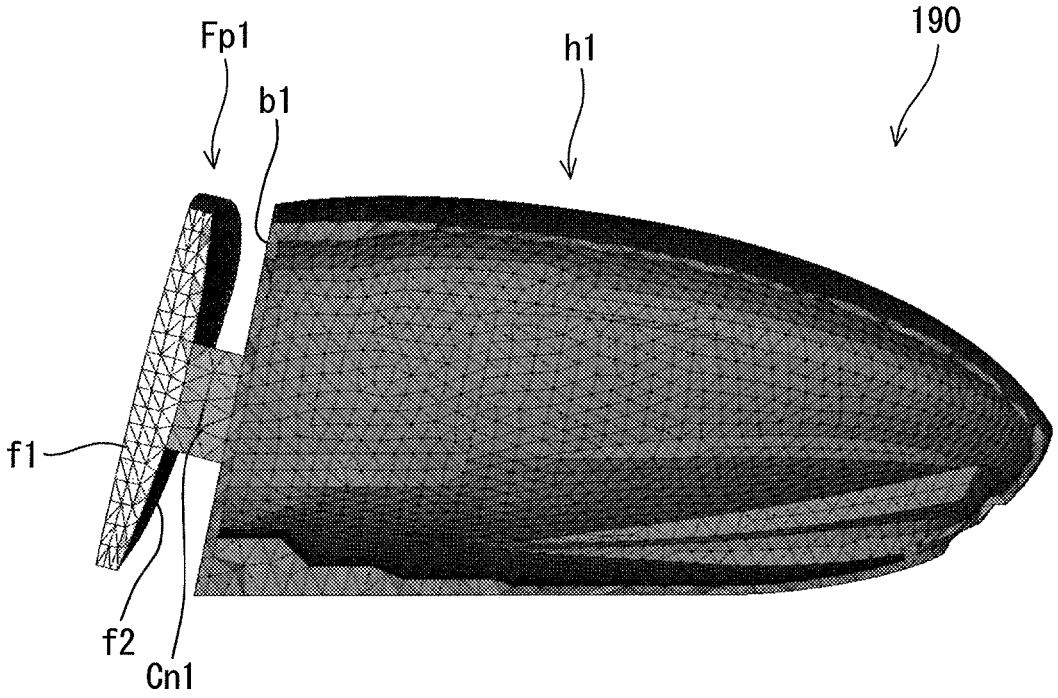
FIG. 42 shows an image of an FE model showing a cross-sectional view taken along line F42-F42 of FIG. 41.

FIGS. 38 to 42 show an image of an FE model of a head 190 according to Example 3. FIG. 38 is a perspective view of the head 190. FIG. 39 is a perspective view of a face part Fp1 of the head 190 viewed from a back side. FIG. 40 is a perspective view of a head body h1 of the head 190. FIG. 41 is a top view of the head 190. FIG. 42 is a cross-sectional view taken along line F42-F42 of FIG. 41. Hatching is not applied to the cross-sectional view.

The specifications of Example 3 and Comparative Example are shown in the following Table 1.

TABLE 1

Specifications of Example and Comparative Example

| | | Unit | Comparative Example | Example 3 |
|---|---|---|---|---|
| Face part | Assumed material | — | 6-22-22S titanium | 6-22-22S titanium |
| | Elastic modulus | GPa | 120 | 120 |
| | Density | g/cm$^3$ | 4.6 | 2.0 |
| | Weight | g | 30.6 | 15.3 |
| Head body (excluding sole and front part) | Assumed material | — | Maraging steel | Maraging steel |
| | Elastic modulus | GPa | 210 | 210 |
| | Density | g/cm$^3$ | 7.8 | 7.8 |
| | Weight | g | 119.7 | 119.7 |
| Sole | Assumed material | — | W—Ni alloy | W—Ni alloy |
| | Elastic modulus | GPa | 530 | 530 |
| | Density | g/cm$^3$ | 8.3 | 8.3 |
| | Weight | g | 40.4 | 40.4 |
| Front part | Assumed material | — | — | 6-22-22S titanium |
| | Elastic modulus | GPa | — | 120 |
| | Density | g/cm$^3$ | — | 2.0 |
| | Weight | g | — | 10.3 |
| Connecting part | Assumed material | — | — | 6-22-22S titanium |
| | Elastic modulus | GPa | — | 120 |
| | Density | g/cm$^3$ | — | 2.0 |
| | Weight | g | — | 5.0 |
| Total number of elements of head | | Piece | 45008 | 54135 |
| Head weight | | g | 190.7 | 190.7 |
| X-coordinate of sweet spot | | mm | 2.0 | 1.8 |
| Y-coordinate of sweet spot | | mm | 6.3 | 6.7 |
| X-coordinate of center of gravity of head | | mm | 27.6 | 27.8 |
| Y-coordinate of center of gravity of head | | mm | −1.9 | −1.7 |
| Z-coordinate of center of gravity of head | | mm | 16.2 | 16.1 |
| Head inertia moment A | | g · cm$^2$ | 2712 | 2669 |
| Head inertia moment B | | g · cm$^2$ | 1157 | 1128 |

Coordinate values of an XYZ coordinate system are described in Table 1. In the XYZ coordinate system, a Y-axis direction is a toe-heel direction; a Z-axis direction is an up-down direction; and an X-axis direction is a direction perpendicular to the Y-axis and the Z-axis.

In respect of exact evaluation, the specific gravities of the face part, the front part, and the connecting part were adjusted so that a position of a center of gravity and a head weight of Examples 3 coincide with a position of a center of gravity and a head weight of Comparative Example. Specifically, as shown in Table 1, the specific gravity of each part was set to 2.0. By the adjustment, the positions of the center of gravity and the sweet spot of Example 3 mostly coincided with the positions of the center of gravity and the sweet spot of Comparative Example. Furthermore, the head weight of Example 3 coincided with the head weight of Comparative Example. Therefore, an effect based on the structure could be correctly evaluated. The difference between the coefficients of restitution of Example 3 and Comparative Example is considered to be caused by the difference between the structures of Example 3 and Comparative Example.

Simulation for making a ball collide with the heads of Example 3 and Comparative Example was carried out. The ball was made to collide with a stationary head at a speed 48.77 m/s in a state where a face surface of the head was set to be perpendicular to the direction of movement of the ball. Hit points were set to the following three places.

(1) standard hit point Hp (2) 5 mm lower from standard hit point Hp (3) 10 mm lower from standard hit point Hp In Example 3 and Comparative Example, a distance in an up-down direction between the standard hit point Hp and a leading edge was 16 mm. A ball placed on a ground (lawn) is often hit by a fairway wood. For this reason, a point hit at a comparatively high frequency is near the standard hit point Hp. In the cases of Example 3 and Comparative Example, a face center Fc was located 3 mm lower from the standard hit point Hp.

Figure 43A:
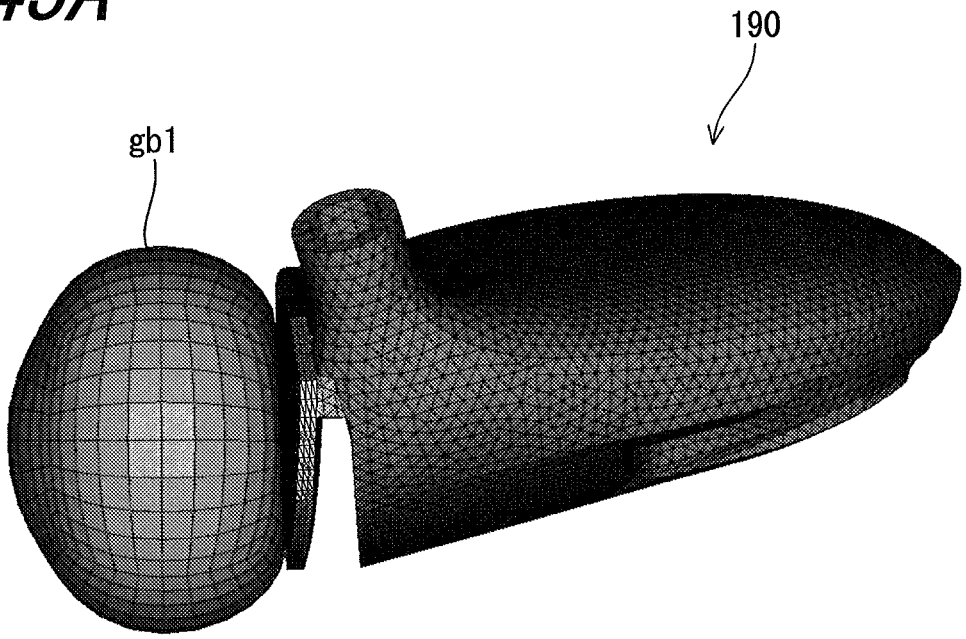
FIGS. 43A and 43B show a simulation image showing a state where the head of Example 3 and a ball collide with each other.
Figure 43B:
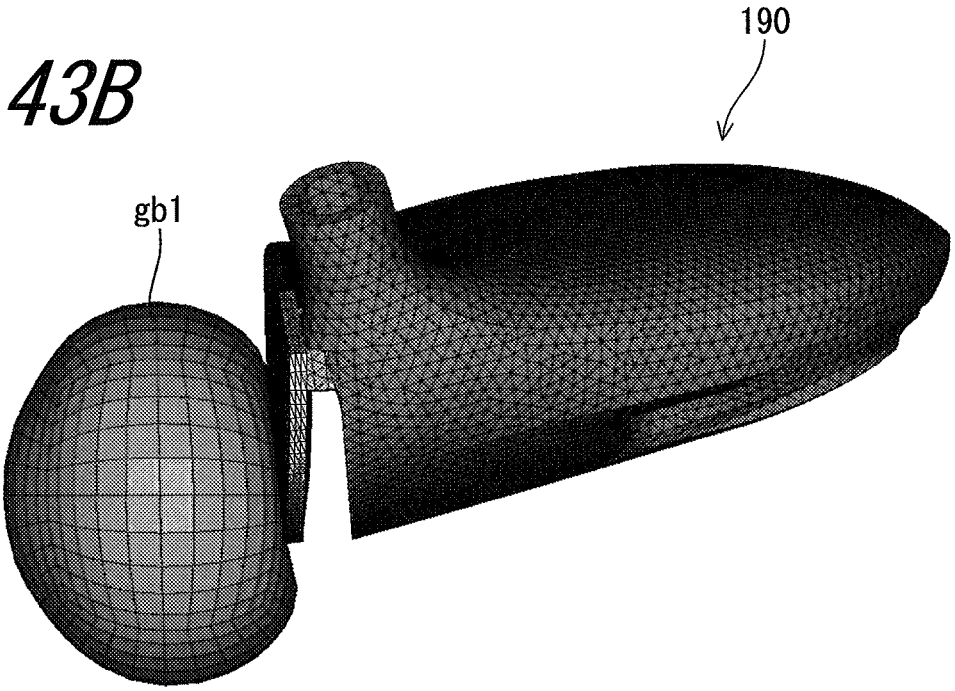

FIGS. 43A and 43B show a simulation image in Example 3. FIG. 43A shows a state where a golf ball gb1 collides with the standard hit point Hp. FIG. 43B shows a state where the golf ball gb1 collides with a point located 10 mm lower from the standard hit point Hp.

As a result of the simulation, the coefficients of restitution were as follows.

(1) hit point: standard hit point Hp coefficient of restitution of Example: 0.8644 coefficient of restitution of Comparative Example: 0.8659

(2) hit point: 5 mm lower from standard hit point Hp coefficient of restitution of Example: 0.8473 coefficient of restitution of Comparative Example: 0.8227

(3) hit point: 10 mm lower from standard hit point Hp coefficient of restitution of Example: 0.8320 coefficient of restitution of Comparative Example: 0.7908

If the hit point was the standard hit point Hp, coefficients of restitution of both Example and Comparative Example mostly coincided with each other. Meanwhile, if the hit point was located lower than the standard hit point Hp, the coefficient of restitution of Example was improved as compared with the coefficient of restitution of Comparative Example. Furthermore, the improvement rate of the coefficient of restitution was larger as the hit point was located on a lower side. That is, while the improvement rate when the hit point was located 5 mm lower was 3.0%, the improvement rate when the hit point was located 10 mm lower was 5.2%. Thus, the structure of Example was confirmed to cause the improvement in the coefficient of restitution of the lower edge part of the face. The advantages of the present invention are apparent.

The invention can be applied to all golf club heads such as a wood type, utility type, hybrid type, iron type, and putter type golf club heads.

The above description is only illustrative and various changes can be made without departing from the scope of the present invention.

What is claimed is:

1. A golf club head comprising:

a head body having a sole, a top portion and a front portion with a front surface;

a face part; and at least one connecting part, wherein the face part includes a face front surface as a hitting face and a face back surface wherein the face part has a uniform thickness;

the connecting part connects the face back surface and the head body front surface to each other;

the connecting part is provided at a position apart from a peripheral edge of the face back surface;

a peripheral edge of the face back surface is separated from the head body by a clearance of 0.2 mm or greater and 10 mm or less between the face back surface and the head body front surface;

no hollow space is present between the face front surface and the face back surface such that the face part is solid;

the face front surface has a face middle region that is defined as an inner side region of an ellipse A having: a center positioned at a center of the face front surface; a major axis which is half a width in a toe-heel direction of the face front surface; and a minor axis which is half a width in an up-down direction of the face front surface;

the face front surface has a face peripheral region that is defined as an outer side region of the ellipse A; and when an average CT value in the face middle region is represented by CT1, and an average CT value in the face peripheral region is represented by CT2, then CT2 is greater than CT1.

2. A golf club head comprising:

a head body having a sole, a top portion and a front portion with a front surface;

a face part; and at least one connecting part, wherein the face part includes a face front surface as a hitting face and a face back surface;

the connecting part connects the face back surface and the head body front portion to each other;

the connecting part is provided at a position apart from a peripheral edge of the face back surface;

no hollow space is present between the face front surface and the face back surface such that the face part is solid; and the connecting part is provided only in an upper region located on an upper side with respect to the face front surface center.

3. A golf club head comprising:

a head body having a sole, a top portion and a front portion with a front surface;

a face part; and two connecting parts, wherein the face part includes a face front surface as a hitting face and a face back surface;

the connecting parts connect the face back surface and the head body front portion to each other;

the connecting parts are provided at a position apart from a peripheral edge of the face back surface; and no hollow space is present between the face front surface and the face back surface such that the face part is solid.

4. A golf club head comprising:

a head body having a sole, a top portion and a front portion with a front surface;

a face part; and two or more connecting parts, wherein the face part includes a face front surface as a hitting face and a face back surface;

the connecting parts connect the face back surface and the head body front portion to each other;

the connecting parts are provided at positions apart from a peripheral edge of the face back surface; and no hollow space is present between the face front surface and the face back surface such that the face part is solid.

5. A golf club head comprising:

a head body having a sole, a top portion and a front portion with a front surface;

a face part; and first and second connecting parts, wherein the face part includes a face front surface as a hitting face and a face back surface;

the first and second connecting parts connect the face back surface and the head body front portion to each other;

the first and second connecting parts are provided at a position apart from a peripheral edge of the face back surface;

no hollow space is present between the face front surface and the face back surface such that the face part is solid;

the first connecting part is provided in a toe region located on a toe side with respect to the face front surface center, the second connecting part is provided in a heel region located on a heel side with respect to the face front surface center; and a clearance extends between the face part and the head body front portion in an up-down direction while passing between the first connecting part and the second connecting part.

* * * * *